US007210720B2

(12) United States Patent
Kehler

(10) Patent No.: US 7,210,720 B2
(45) Date of Patent: May 1, 2007

(54) TIMED ROTATION TOOL ASSEMBLY AND ACTUATOR

(75) Inventor: Michael Kevin Kehler, Orting, WA (US)

(73) Assignee: 1994 Weyer Family Limited Partnership, Enumclaw, WA (US)

( * ) Notice: Subject to any disclaimer, the term of this patent is extended or adjusted under 35 U.S.C. 154(b) by 990 days.

(21) Appl. No.: 10/186,850

(22) Filed: Jun. 28, 2002

(65) Prior Publication Data

US 2004/0000811 A1 Jan. 1, 2004

(51) Int. Cl.
*B25J 15/00* (2006.01)

(52) U.S. Cl. ..... 294/106; 294/88; 92/31; 92/136

(58) Field of Classification Search ..... 294/88, 294/106, 68.23; 92/31–33, 136; 37/461, 37/184

See application file for complete search history.

(56) References Cited

U.S. PATENT DOCUMENTS 2,945,387 A * 7/1960 Geyer ..... 74/89.27
3,343,693 A 9/1967 Becker
4,590,816 A 5/1986 Weyer
4,607,873 A * 8/1986 Nusbaumer et al. ..... 294/88
4,667,528 A 5/1987 Weyer
4,683,767 A 8/1987 Weyer
4,691,582 A 9/1987 Weyer
4,741,250 A 5/1988 Weyer
4,745,847 A * 5/1988 Voss ..... 92/33
4,773,812 A * 9/1988 Bayne et al. ..... 414/408
4,858,486 A 8/1989 Weyer
4,858,701 A 8/1989 Weyer
4,881,419 A 11/1989 Weyer
4,945,778 A 8/1990 Weyer
4,960,007 A 10/1990 Weyer (Continued)

FOREIGN PATENT DOCUMENTS

DE 20107206 4/2001

(Continued)

OTHER PUBLICATIONS

*The New Generation*, (visited Jun. 26, 2002), http://www.kinshofer.com/europe/ger/main/info2/site.html.

*Primary Examiner*—Dean J. Kramer
(74) *Attorney, Agent, or Firm*—George C. Rondeau, Jr.; Davis Wright Tremaine LLP

(57) ABSTRACT

A fluid-powered tool assembly having first and second tool members, a body, and first and second rotatable shafts. The first shaft is attached to the first tool member for rotation therewith about a first axis, and the second shaft is attached to the second tool member for rotation therewith about a second axis. A linear-to-rotary force transmitting member is mounted for reciprocal longitudinal movement in response to selective application of pressurized fluid thereto. The force transmitting member engages the first and second shafts to translate longitudinal movement of the force transmitting member in a first longitudinal direction into simultaneous rotational movement of the first shaft about the first axis in a first rotational direction and into rotational movement of the second shaft about the second axis in a second rotational direction, and to translate longitudinal movement of the force transmitting member in a second longitudinal direction opposite the first into opposite simultaneous rotational movements of the first and second shafts.

42 Claims, 12 Drawing Sheets

U.S. PATENT DOCUMENTS

| | | | |
|---|---|---|---|
| 5,027,667 | A | 7/1991 | Weyer |
| 5,487,230 | A | 1/1996 | Weyer |
| 5,671,652 | A | 9/1997 | Weyer |
| 6,370,801 | B1 | 4/2002 | Weyer et al. |
| 6,896,306 | B2 | 5/2005 | Schierholz |

FOREIGN PATENT DOCUMENTS

| | | |
|---|---|---|
| WO | 0218714 | 3/2002 |

* cited by examiner

TIMED ROTATION TOOL ASSEMBLY AND ACTUATOR

BACKGROUND OF THE INVENTION

1. Field of the Invention

The present invention relates generally to fluid-powered actuators and tool assemblies using such actuators, for timed rotational movement of two tool members positioned to cooperate with each other, typically mounted on a boom or arm of a vehicle or stationary platform.

2. Description of the Related Art

Assemblies such as large grapples, brush rakes, refuse collection tines or fingers, clamshell buckets, and buckets with bucket extensions or lids have been employed in the past for collection and sorting of large and small objects or quantities of material, excavation and picking up refuse containers. Many of these assemblies have two tools or members, which are selectively operable to work together. The assembly is generally attached to a boom or other arm of a platform such as a vehicle. The two tool members of the assembly are positioned to selectively move one toward and away from the other to cooperatively engage, pick up or grasp an object or material.

Generally, means are provided to separately supply rotational torque to the tool members in order to rotatable move one tool member relative to the other. The operational limitation of a particular assembly is directly dependent upon the maximum amount of torque that can be supplied to the tool members. If the torque is not sufficient, the object size or the quantity of the object or material to be engaged, picked up or grasped is limited.

It will therefore be appreciated that there has long been a significant need for an improved tool assembly and actuator used therewith. The present invention fulfills these needs and further provides other related advantages.

BRIEF SUMMARY OF THE INVENTION

The present invention resides in a fluid-powered rotary actuator for providing timed rotational movement of first and second external members, typically tool members. The actuator includes a body having a longitudinal axis, a first rotatable member, second rotatable member, and a linear-to-rotary force transmitting member. The first rotatable member is rotatably disposed with respect to the body for rotation about a first rotation axis with a portion adapted for coupling to the first external member for rotational movement of the first external member with the first rotatable member as a unit. The second rotatable member rotatably is disposed with respect to the body for rotation about a second axis with a portion adapted for coupling to the second external member for rotational movement of the second external member with the second rotatable member as a unit.

The linear-to-rotary force transmitting member is mounted for reciprocal longitudinal movement in response to selective application of pressurized fluid thereto. The force transmitting member engages the first and second rotatable members to translate longitudinal movement of the force transmitting member in a first longitudinal direction into rotational movement of the first rotatable member about the first axis relative to the body in a first rotational direction and into rotational movement of the second rotatable member about the second axis relative to the body in a second rotational direction, and to translate longitudinal movement of the force transmitting member in a second longitudinal direction opposite the first longitudinal direction into rotational movement of the first rotatable member about the first axis relative to the body in a rotational direction opposite the first rotational direction and into rotational movement of the second rotatable member about the second axis relative to the body in a rotational direction opposite the second rotational direction.

In one embodiment of the actuator, the force transmitting member engages the body to translate longitudinal movement of the force transmitting member in the first and second longitudinal directions into rotational movement of the first and second rotatable members about the first and second axes, respectively, relative to the body.

The first and second rotational directions may be opposite rotational directions, with rotational movement of the first and second rotatable members in the first and second rotational directions, respectively, in response to longitudinal movement of the force transmitting member in the first longitudinal direction, producing movement of the first and second external members toward each other, and rotational movement of the first and second rotatable members in the rotational directions opposite the first and second rotational directions, respectively, in response to longitudinal movement of the force transmitting member in the second longitudinal direction, producing movement of the first and second external members away from each other.

An embodiment of the actuator using third and fourth rotatable members may also be constructed with the third rotatable member rotatably disposed with respect to the body for rotation about a third rotation axis, with the third rotatable member having a portion adapted for coupling to the second external member for rotational movement of the second external member with the third rotatable member as a unit. The fourth rotatable member rotatably may be disposed with respect to the body for rotation about a fourth rotation axis, with the fourth rotatable member having a portion adapted for coupling to the first external member for rotational movement of the first external member with the fourth rotatable member as a unit. The linear-to-rotary force transmitting member may engage the third and fourth rotatable members to translate longitudinal movement of the force transmitting member in the first longitudinal direction into rotational movement of the third rotatable member about the third axis relative to the body in a third rotational direction and into rotational movement of the fourth rotatable member about the fourth axis relative to the body in a fourth rotational direction, and to translate longitudinal movement of the force transmitting member in the second longitudinal direction into rotational movement of the third rotatable member about the third axis relative to the body in the rotational direction opposite the third rotational direction and into rotational movement of the fourth rotatable member about the fourth axis relative to the body in the rotational direction opposite the fourth rotational direction.

The actuator may be constructed with the first and second rotatable members each having a grooved portion, and with the force transmitting member having a grooved first portion engaging the first rotatable member grooved portion and a grooved second portion engaging the second rotatable member grooved portion to translate longitudinal movement of the force transmitting member in the first longitudinal direction into rotational movement of the first rotatable member about the first axis relative to the body in the first rotational direction and into rotational movement of the second rotatable member about the second axis relative to the body in the second rotational direction, and to translate longitudinal movement of the force transmitting member in the second longitudinal direction into rotational movement of the first rotatable member about the first axis relative to the body in the rotational direction opposite the first rotational direction and into rotational movement of the second rotatable member about the second axis relative to the body in the rotational direction opposite the second rotational direction.

In this embodiment, the actuator includes a third rotatable member rotatably disposed with respect to the body for rotation about a third rotation axis, the third rotatable member having a portion adapted for coupling to the second external member for rotational movement of the second external member with the third rotatable member as a unit, with the third rotatable member having a grooved portion. The actuator of this embodiment further includes a fourth rotatable member rotatably disposed with respect to the body for rotation about a fourth rotation axis, the fourth rotatable member having a portion adapted for coupling to the first external member for rotational movement of the first external member with the fourth rotatable member as a unit, with the fourth rotatable member having a grooved portion. The linear-to-rotary force transmitting member has a grooved third portion engaging the third rotatable member grooved portion and a grooved fourth portion engaging the fourth rotatable member grooved portion to translate longitudinal movement of the force transmitting member in the first longitudinal direction into rotational movement of the third rotatable member about the third axis relative to the body in a third rotational direction and into rotational movement of the fourth rotatable member about the fourth axis relative to the body in a fourth rotational direction, and to translate longitudinal movement of the force transmitting member in the second longitudinal direction into rotational movement of the third rotatable member about the third axis relative to the body in the rotational direction opposite the third rotational direction and into rotational movement of the fourth rotatable member about the fourth axis relative to the body in the rotational direction opposite the fourth rotational direction.

The actuator may be constructed with the body also having a grooved portion. In this embodiment, the first rotatable member has a grooved portion, and the second rotatable member has a grooved portion. The force transmitting member has a grooved first portion engaging the first rotatable member grooved portion, a grooved second portion engaging the second rotatable member grooved portion and a grooved third portion engaging the body grooved portion to translate longitudinal movement of the force transmitting member in the first longitudinal direction into rotational movement of the first rotatable member about the first axis relative to the body in the first rotational direction and into rotational movement of the second rotatable member about the second axis relative to the body in the second rotational direction, and to translate longitudinal movement of the force transmitting member in the second longitudinal direction into rotational movement of the first rotatable member about the first axis relative to the body in the rotational direction opposite the first rotational direction and into rotational movement of the second rotatable member about the second axis relative to the body in the rotational direction opposite the second rotational direction.

This embodiment may also include a third rotatable member and a fourth rotatable member, much as described above. The linear-to-rotary force transmitting member has a grooved fourth portion engaging the third rotatable member grooved portion and a grooved fifth portion engaging the fourth rotatable member grooved portion to translate longitudinal movement of the force transmitting member in the first longitudinal direction into rotational movement of the third rotatable member about the third axis relative to the body in a third rotational direction and into rotational movement of the fourth rotatable member about the fourth axis relative to the body in a fourth rotational direction, and to translate longitudinal movement of the force transmitting member in the second longitudinal direction into rotational movement of the third rotatable member about the third axis relative to the body in the rotational direction opposite the third rotational direction and into rotational movement of the fourth rotatable member about the fourth axis relative to the body in the rotational direction opposite the fourth rotational direction.

In at least one embodiment of the actuator, the first rotatable member includes an idler mount portion adapted to rotatably mount a portion of the second external member thereto to allow independent rotation of the second external member relative to the first shaft idler mount portion, and the second rotatable member includes an idler mount portion adapted to rotatably mount a portion of the first external member thereto to allow independent rotation of the first external member relative to the second shaft idler mount portion.

In one embodiment of the actuator designed for use with a third external member, the body is adapted for coupling to the third external member for movement of the body with the third external member as a unit. The body includes a central tie rod positioned along the body axis and retaining the first and second rotatable members against longitudinally outward movement relative to each other. The tie rod comprises at least a portion of the body adapted for coupling to the third external member.

In one embodiment, the body of the actuator has spaced apart first and second longitudinal end portions, with the portions of the first and second rotatable members adapted for coupling to the first and second external members are both located at the body first end portion.

The invention may also be embodied with the actuator having a body with spaced apart first and second longitudinal end portions, with the first and second rotatable members each extending between the body first and second end portions and with the first and second rotation axes thereof in spaced apart arrangement. In this embodiment, the first rotatable member may have first and second end portions, each adapted for coupling to the first external member, and the second rotatable member may have first and second end portions, each adapted for coupling to the second external member. The first end portions of the first and second rotatable members is located at the body first end portion and the second end portions of the first and second rotatable members are located at the body second end portion. The force transmitting member may be a piston sleeve with first and second spaced apart apertures therein and having the first rotatable member extending through the first aperture and the second rotatable member extending through the second aperture.

In yet another embodiment of the actuator, the body is a first body and the actuator includes a second body, with the first body being rotatable relative to the second body. Further, the actuator may have another linear-to-rotary force transmitting member mounted for reciprocal longitudinal movement in the first and second longitudinal directions in response to selective application of pressurized fluid thereto. The another force transmitting member engages the first and second bodies to translate longitudinal movement of the another force transmitting member in a third longitudinal direction into one of clockwise or counterclockwise relative rotational movement of the first body relative to the second body and to translate longitudinal movement of the another force transmitting member in a fourth longitudinal direction into the other of clockwise or counterclockwise relative rotational movement of the first body relative to the second body.

Other features and advantages of the invention will become apparent from the following detailed description, taken in conjunction with the accompanying drawings.

BRIEF DESCRIPTION OF THE SEVERAL VIEWS OF THE DRAWING(S)

DETAILED DESCRIPTION OF THE INVENTION

Figure 1:
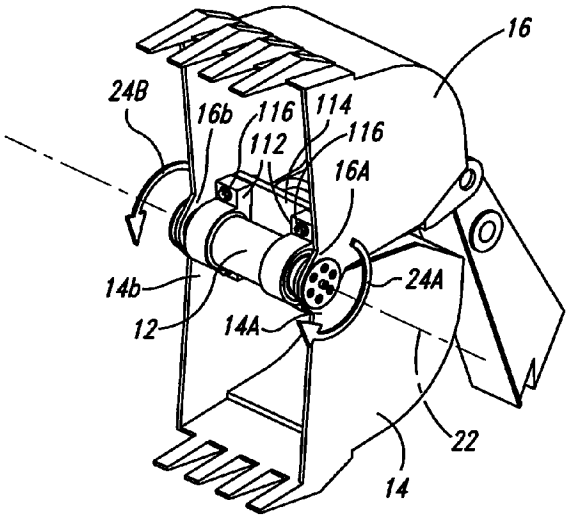
FIG. 1 is a front perspective view of a clamshell bucket assembly with a fluid-powered rotary actuator embodying the present invention, showing the buckets rotated fully away from each other.
Figure 2:
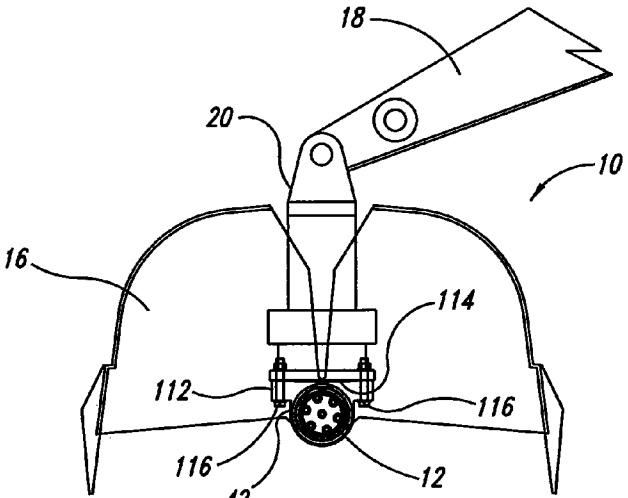
FIG. 2 is a side elevational view of the clamshell bucket assembly of FIG. 1.
Figure 3:
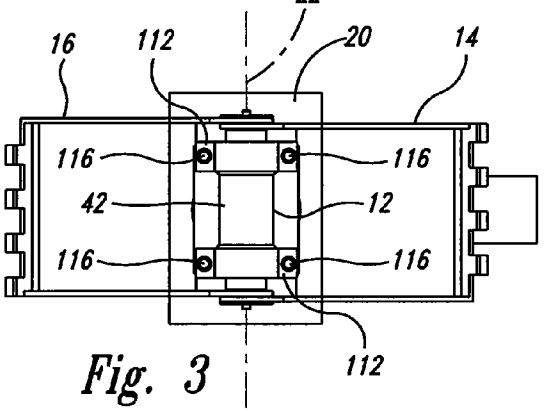
FIG. 3 is a front view of the clamshell bucket assembly of FIG. 1.

As shown in the drawings for purposes of illustration, the present invention is embodied in a fluid-powered tool assembly 10 and a fluid-powered rotary actuator 12 used therewith for timed rotation of first and second tool members 14 and 16. As shown in FIGS. 1–3, the tool assembly 10 is usable with a boom arm 18 connected to a support platform such a vehicle (not shown). The support platform may also be a stationary platform. The boom arm 18 may have multiple boom arm sections pivotally connected together, and is typically pivotally mounted at its lower end to the vehicle or stationary platform, although non-pivotal mounting may be used if desired. Conventional hydraulic cylinders, rotary actuators or other actuation means (not shown) may be used for raising and lowering the boom arm 18, extending the boom arm and moving the boom arm laterally with respect to the support platform.

A boom mounting member 20 is pivotally connected to the upper end of the boom arm 18, and if desired, can be rotated relative to the boom arm using conventional hydraulic cylinders, rotary actuators or other actuation means (not shown). The tool assembly 10 is rigidly attached to the boom mounting member 20 for movement therewith. In other applications, the tool assembly 10 may be mounted to other mounting surfaces, platforms or frames, as appropriate to perform the work desired using the tool assembly.

Figure 4:
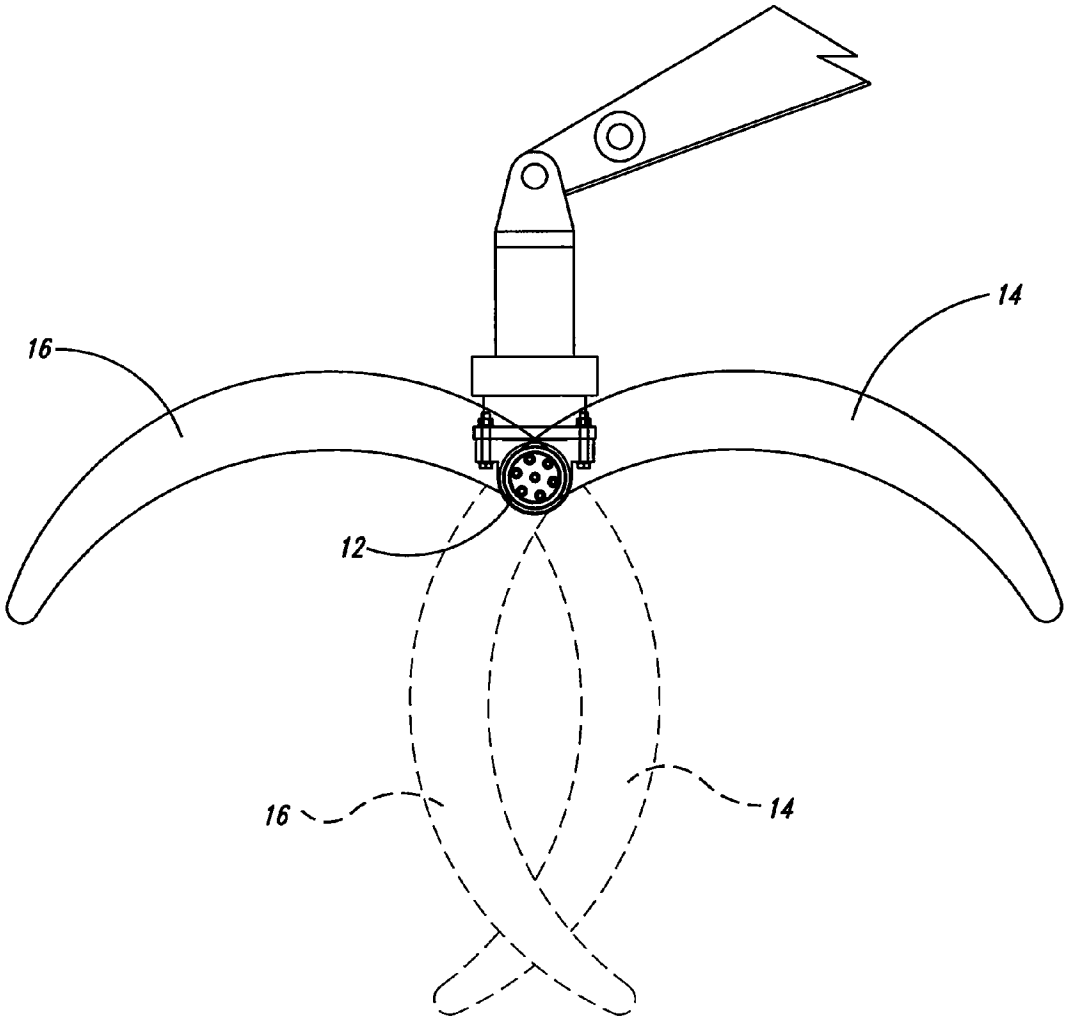
FIG. 4 is a side elevational view of a grapple assembly with a fluid-powered rotary actuator embodying the present invention, with the grapples shown in solid line rotated fully away from each other and in broken line rotated fully toward each other.

A first embodiment of the tool assembly 10 is illustrated in FIGS. 1–3, with the tool members 14 and 16 being two opposing clamshell buckets. It should be understood that the present invention may be practiced using other tool members, and is not limited to buckets or other collection tools and devices. These may include grapples as shown in FIG. 4, refuse collection tines as shown in FIGS. 5A–5C, 6 and 7, brush rakes, and buckets with bucket extensions or lids (not shown), to name a few. These tools are often employed for collection and sorting of large and small objects or quantities of material, excavation and picking up refuse containers The first and second tool members 14 and 16 are connected to the actuator 12 for timed rotational movement of the first and second tool members, often toward and away from each other. Other tools may have different timed rotational movement. The actuator provides rotational torque to the first and second tool members.

Referring to the tool assembly 10 of FIGS. 1–3, operation of the actuator 12 causes the first and second tool members 14 and 16 to simultaneously rotate about a longitudinal axis 22 of the actuator relative to the boom mounting member 20 to provide timed rotational movement of both tool members, not just rotational movement of one tool member relative to the other. As shown in FIG. 1, the actuator 12 can be selectively operated to simultaneously produce clockwise rotation of the first tool member 14, as indicated by arrow 24A, and counterclockwise rotation of the second tool member 16, as indicated by arrow 24B, relative to the boom mounting member 20, to cause the first and second tool members to rotationally move toward each other for grasping of an object therebetween or picking up material in the buckets. Similarly, the actuator 12 can be selectively operated to simultaneously produce counterclockwise rotation of the first tool member 14, in the rotational direction opposite arrow 24A, and clockwise rotation of the second tool member 16, in the rotational direction opposite arrow 24B, to cause the first and second tool members to rotationally move away from each other for releasing of a grasped object or releasing material within the buckets.

While the tool assembly 10 of FIGS. 1–3 is designed for one of the first and second tool members 14 and 16 to move clockwise when the other moves counterclockwise, thus to simultaneously move them toward or away from each other, in other embodiments, the tool assembly may have the first and second tool members simultaneously move clockwise together or simultaneously move counterclockwise together, either by the same or different amounts.

Figure 8:
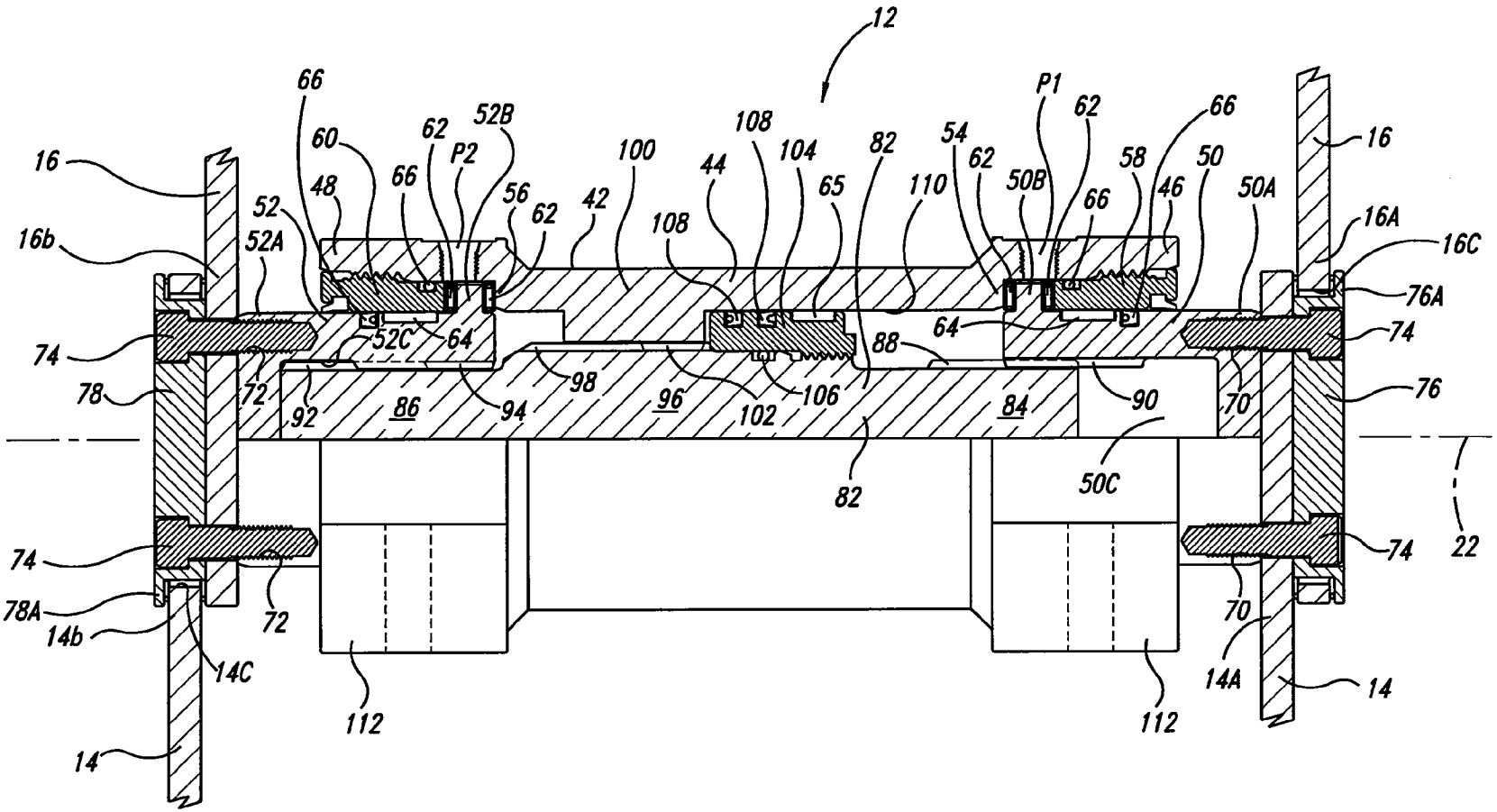
FIG. 8 is an enlarged, sectional, side elevational view of the fluid-powered rotary actuator of FIG. 1 with coaxial timed rotation members for attachment of tool members at opposite longitudinal ends of the actuator.

The construction of the actuator 12 and the attachment of the first and second tool members 14 and 16 thereto are shown in FIG. 8. As can be seen in FIG. 8, the actuator 12 has an elongated housing or body 42 with a cylindrical sidewall 44 and first and second longitudinal ends 46 and 48, respectively. Separate first and second rotatable drive members or output shafts 50 and 52, respectively, are coaxially positioned within the body 42 and supported for rotation relative to the body. The first shaft 50 extends axially out of the body 42 at the first body end 46, and has an attachment portion 50A at the first body end. The second shaft 52 extends axially out of the body 42 at the second body end 48, and has an attachment portion 52A at the second body end. The first shaft 50 further includes a flange portion 50B positioned within the body 42 inward of the first body end 46 adjacent to an axially outward facing first shoulder 54 of the body sidewall 44. Similarly, the second shaft 52 further includes a flange portion 52B positioned within the body 42 inward of the second body end 48 adjacent to an axially outward facing second shoulder 56 of the body sidewall 44.

Exteriorly threaded first and second annular retainer nuts 58 and 60 are positioned within the body 42. The first retainer nut 58 is threadably attached to an interiorly threaded portion of the body sidewall 44 toward the first body end 46 and the second retainer nut 60 is threadably attached to an interiorly threaded portion of the body sidewall 44 toward the second body end 48. The first and second retainer nuts 58 and 60 are located axially outward of the corresponding first and second shoulders 54 and 56 of the body sidewall 44, with the flange portion 50B of the first shaft 50 positioned between the first shoulder 54 and the first retainer nut 58 to prevent axial movement of the first shaft within the body 42, and the flange portion 52B of the second shaft 52 positioned between the second shoulder 56 and the second retainer nut 60 to prevent axial movement of the second shaft within the body. The first and second shaft nuts 58 and 60 are locked in place against rotation with the first and second shafts 50 and 52.

Thrust bearings 62 are disposed between the first and second shaft flange portions 50B and 52B, and both of the corresponding first and second shoulders 54 and 56, and the first and second retainer nuts 58 and 60 to support the first and second shafts against longitudinal thrust loads. A radial bearing 64 is positioned between each of the first and second shafts 50 and 52 and the corresponding first and second retainer nuts 58 and 60 to support the shafts against radial loads. Seals 66 are disposed between the first and second shaft nuts 58 and 60, and both of the corresponding first and second shafts 50 and 52, and the body sidewall 44 to provide a fluid-tight seals therebetween.

The exterior end surfaces of the attachment portions 50A and 52A of the first and second shafts 50 and 52 are flat and each have a plurality of threaded apertures 70 and 72, respectively, which threadably receive attachment bolts 74. The first tool member 14 has a first side projecting attachment portion 14A and a second side projecting attachment portion 14B, and the second tool member 16 has a first side projecting attachment portion 16A, and a second side projecting attachment portion 16B for attachment of the first and second tool members to the actuator 12. In the case of the illustrated clamshell buckets, these comprise portions of the right and left sidewalls of each bucket.

As can best be seen in FIG. 8, the first attachment portion 14A of the first tool member 14 is positioned in contact with the end surface of the first attachment portion 50A of the first shaft 50 and rigidly attached thereto by the attachment bolts 74 for rotational movement with the first shaft. The first attachment portion 14A of the first tool member 14 is clamped between a first end support member 76 and the first shaft attachment portion 50A by the attachment bolts 74 which extend through apertures in the first end support member 76 and the first attachment portion 14A of the first tool member 14 and are threadably received in the threaded apertures 70. The first attachment portion 16A of the second tool member 16 is rotatably mounted (idle mounted) on the first end support member 76 so that it can rotate freely, independent of the first shaft 50 to which the first end support member is rigidly attached, but yet be supported by the first end support member for transmitting radial and axial loads during use. This is accomplished by providing the first attachment portion 16A of the second tool member 16 with an aperture 16C through which the first end support member 76 projects. An axially outward retainer flange 76A allows independent rotation of the second tool member 16 but retains it in place on the first end support member 76. Bearings may be used to facilitate the rotation. As will be described in greater detail below, the first shaft 50 provides rotational drive to the first tool member 14, and the second shaft 52 provides rotational drive to the second tool member 16.

Similarly, the second attachment portion 16B of the second tool member 16 is positioned in contact with the end surface of the attachment portion 52A of the second shaft 52 and rigidly attached thereto by the attachment bolts 74 for rotational movement with the second shaft. The second attachment portion 16B of the second tool member 16 is clamped between a second end support member 78 and the second shaft attachment portion 52A by the attachment bolts 74 which extend through apertures in the second end support member 78 and the second attachment portion 16B of the second tool member 16 and are threadably received in the threaded apertures 72. The second attachment portion 14B of the first tool member 14 is rotatably mounted (idle mounted) on the second end support member 78 so that it can rotate freely, independent of the second shaft 52 to which the second end support member is rigidly attached, but yet be supported by the second end support member against loads encountered during use by the first tool member. This is accomplished by providing the second attachment portion 14B of the first tool member 14 with an aperture 14C through which the second end support member 78 projects. An axially outward retainer flange 78A which allows independent rotation of the first tool member 14 but retains it in place on the second end support member 78. Bearings may be used to facilitate the rotation. This construction provides a straddle mounting of the first and second tool members 14 and 16 to the actuator 12 which for a wide tool like the clamshell buckets illustrated in FIGS. 1–3 provides a stronger and more durable mounting arrangement that can handle the loads on the buckets encountered when digging or grasping a non-uniform object while still providing rotary drive to each bucket from only one end of the actuator body 42.

As shown in FIG. 8, the actuator 12 includes an elongated splined piston 82 coaxially and reciprocally mounted generally within the body 42 coaxial with the first and second shafts 50 and 52. The piston 82 has a first end portion 84, which extends into an axially inward open chamber 50C of the first shaft 50, and a second end portion 86, which extends into an axially inward open chamber 52C of the second shaft 52. The piston first end portion 84 has outer helical splines 88 over a portion of its length which mesh with inner helical splines 90 of the first shaft chamber 50C, and the piston second end portion 86 has outer helical splines 92 over a portion of its length which mesh with inner helical splines 94 of the second shaft chamber 52C. The piston 82 has a mid-portion 96 with outer helical splines 98 over a portion of its length which mesh with an interior ring gear portion 100 of the body sidewall 44 having inner helical splines 102.

The meshing splines can be threaded in the direction (e.g., left-handed or right-handed) and with the lead desired to produce simultaneous counter-rotation of the first and second tool members 14 and 16 in a desired amount per unit of axial motion of the piston 82, as would typically be the case for the clamshell buckets illustrated in FIGS. 1–3, but also may be splined to produce simultaneous rotation of the first and second tool members in the same rotational direction.

In the actuator 12 of FIG. 8, the piston 82 includes an annular piston head portion 104, which is threadably attached to the mid-portion 96 of the piston with a seal 106 disposed therebetween. Seals 108 are disposed between the piston head portion 104 and a smooth interior wall portion 110 of the body sidewall 44 to provide a fluid-tight seal therebetween. A radial bearing 65 is positioned between the piston head portion 104 and the smooth interior wall portion 110 of the body sidewall 44 to support the piston 82 against radial loading.

As will be readily understood, reciprocation of the piston 82 within the body 42 occurs when hydraulic oil, air or any other suitable fluid under pressure selectively enters through one or the other of a first port P1 which is in fluid communication with a fluid-tight compartment within the body to a side of the piston head portion 104 toward the first body end 46 or through a second port P2 which is in fluid communication with a fluid-tight compartment within the body to a side of the piston head portion toward the second body end 48. As the piston head portion 104 and the piston 82, of which the piston head portion is a part, linearly reciprocates in an axial direction within the body 42, the outer splines 98 of the piston mid-portion 96 engage or mesh with the inner splines 102 of the body sidewall 44 to prevent rotation of the piston, where both the outer splines 98 and the inner splines 102 are straight. If desired, the splines 98 and 102 may be helical to also cause rotation of the piston 82 as it linearly reciprocates within the body 42. The linear and rotational movement of the piston 82 is simultaneously transmitted through the outer splines 88 and 92 of the piston to the inner splines 90 and 94, respectively, of the first and second shafts 50 and 52 to cause the shafts to simultaneously rotate. The smooth interior wall portion 110 of the body sidewall 44 has sufficient axial length to accommodate the full end-to-end reciprocating stroke travel of the piston 82 within the body 42. As noted above, longitudinal movement of the first and second shafts 50 and 52 is restricted, thus linear movement of the piston 82 is converted into rotational movement of the first and second shafts. The amount of rotation and the output torque produced depends on the slope and direction of turn of the various splines, and the fluid pressure used.

In more detail, the application of fluid pressure to the first port P1 produces axial movement of the piston 82 toward the second body end 48. The application of fluid pressure to the second body port P2 produces axial movement of the piston 82 toward the body first end 46. The actuator 12 provides simultaneous rotational movement of the first and second shafts 50 and 52, relative to the body 42 (and hence relative to the boom mounting member 20 to which attached) through the conversion of linear movement of the piston 82 into rotational movement of the shafts. The first and second shafts 50 and 52 are selectively rotated by the application of fluid pressure, and the rotation is transmitted to the first and second tool members 14 and 16 to selectively rotate the first and second tool members about the axis 22 of the actuator 12 relative to the body 42. The rotary drive to the first tool member 14 is transmitted by the first shaft 50 by its rigid attachment thereto at the first body end 46, and the rotary drive to the second tool member 16 is transmitted by the second shaft 52 by its rigid attachment thereto at the second body end 48.

The body 42 of the actuator 12 has mounting flanges 112 by which the body is attached to a mounting face 114 of the boom mounting member 20 using attachment bolts 116, as best seen in FIGS. 1–3. In such manner, the first and second tool members 14 and 16 simultaneously rotate relative to the body 42 and the boom mounting member 20 to which the body is attached when the piston 82 is moved linearly by the application of fluid pressure to one of the first and second body ports P1 and P2.

Figure 9B:
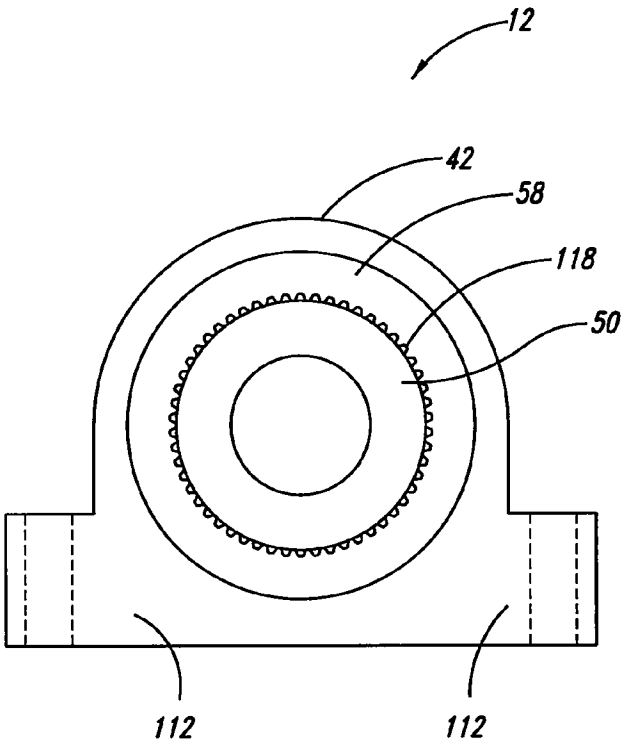
FIG. 9B is an end view of the actuator of FIG. 9A.
Figure 9A:
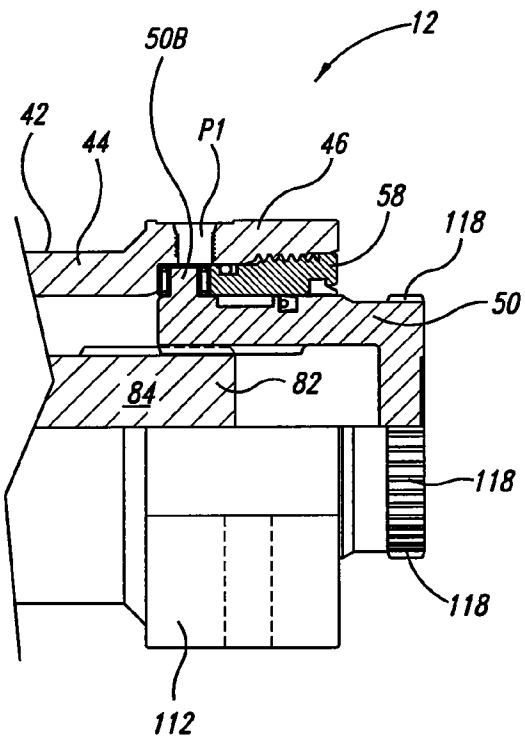
FIG. 9A is a fragmentary, sectional, side elevational view of an alternative embodiment of the fluid-powered rotary actuator of FIG. 8 using splines for attachment of clamshell buckets or other tool members.

An alternative actuator 12 is shown in FIGS. 9A and 9B where the attachment portion 50A of the first shaft 50 at the first body end 46 and the attachment portion 52A of the second shaft 52 at the second body end 48 use a different construction to attach the first and second tool members 14 and 16 thereto. In this embodiment, the attachment portions 50A and 52A have splines 118 about their perimeter by which they transmit rotary drive to the first attachment portion 14A of the first tool member 14 and to the second attachment portion 16B of the second tool member 16, respectively, rather than using the attachment bolts 74 of the embodiment of FIG. 8. Of course, the first attachment portion 14A and the second attachment portion 16B have corresponding mating splines. The first and second end support members 76 and 78 are still used to rotatably mount and retain the first attachment portion 16A and the second attachment portion 14B to the first and second shafts 50 and 52, respectively, as described above for the embodiment of FIG. 8.

Figure 5B:
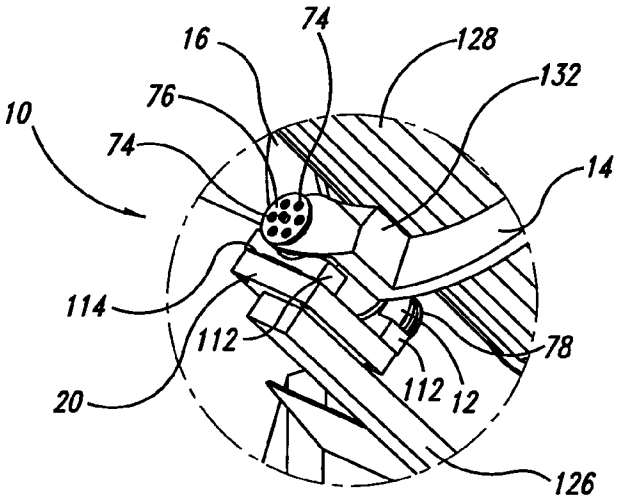
FIG. 5B is an enlarged, sectional view of the area of FIG. 5A encircled by line 5B.
Figure 5A:
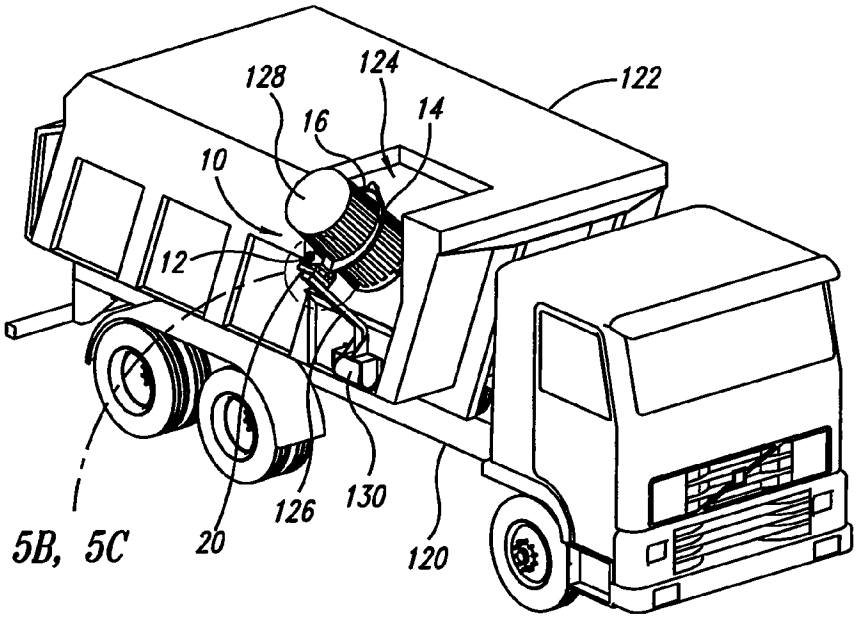
FIG. 5A is a front perspective view of a refuse container handling assembly with a fluid-powered rotary actuator embodying the present invention, shown mounted on a refuse truck with refuse collection tines grasping and dumping a refuse container.
Figure 6:
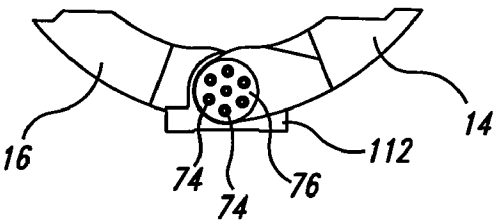
FIG. 6 is an enlarged, sectional side elevational view of the actuator and refuse collection tines of FIG. 5A.
Figure 7:
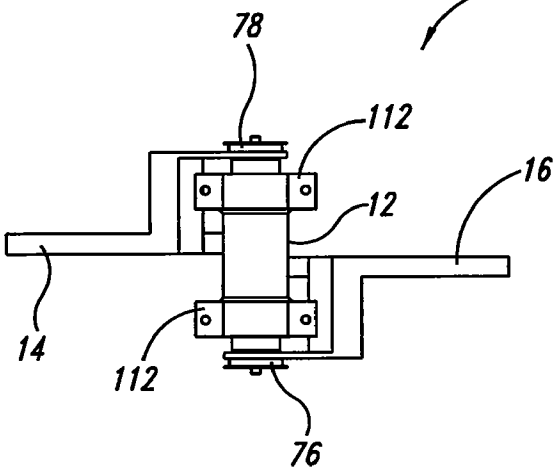
FIG. 7 is a sectional, top plan view of the actuator and refuse collection tines of FIG. 6.

An alternative embodiment of the fluid-powered tool assembly 10 is shown in FIG. 4 as a grapple using basically the same actuator 12 as described above for FIG. 8. In this embodiment the first and second tool members 14 and 16 are fingers or tines. Each of the first and second tool members may comprise a single tine or multiple tines. As described above, the first and second tool members 14 and 16 are connected to the actuator 12 for timed rotational movement toward and away from each other, for grasping items between the cooperating tines. If the first and second tool members 14 and 16 are each a single tine, each can have an axially inward bend so that the tines of the first and second tool members are each offset axially inward to rotate through a transverse plane (or closely positioned together individual planes) approximately midway between the first and second body ends 46 and 48 of the actuator 12, much as shown in FIGS. 5B and 7 for a refuse can collection embodiment which will be described below.

If appropriate for the work to be performed, especially if each of the first and second tool members has multiple tines (such as 2, 3 or 4 spaced apart along the length of the actuator) and the loads on the actuator 12 would be too great, the first and second tool members may be straddle mounted on the actuator much as described above for the clamshell buckets of FIGS. 1–3. With straddle mounting, each of the first and second tool members 14 and 16 may have spaced apart first and second attachment portions (not shown, but somewhat like the first and second attachment portions 14A and 16A, and 14B and 16B of the clamshell buckets), with one attachment portion of each tool member being supplied rotary drive by a corresponding one of the first and second shafts 50 and 52 at one end of the actuator and with the other attachment member being idle mounted to the other of the first and second shafts at the other end of the actuator.

Another alternative embodiment of the fluid-powered tool assembly 10 is shown in FIGS. 5A–5B, 6 and 7 as a refuse can collection assembly using basically the same actuator 12 as described above for FIG. 8. In this embodiment the fluid-powered tool assembly 10 is mounted to a refuse collection truck 120 having a refuse collection dump bin 122 with a refuse collection bin opening 124. An arm or boom 126 is pivotally connected at its lower end to the dump bin 122 at the bin opening 124 and has the boom mounting member 20 rigidly attached to an upper end of the boom. The tool assembly 10 is attached to the boom mounting assembly by the mounting flanges 112 of the body 42 of the actuator 12.

In this embodiment, the first and second tool members 14 and 16 are a pair of opposing curved fingers or tines sized to grasp and pickup a refuse container 128. As described above, the first and second tool members 14 and 16 are connected to the actuator 12 for simultaneous timed rotational movement toward and away from each other, for grasping and releasing the refuse container 128 therebetween. The lower end of the boom 126 is pivotable by an operator 130 that can pivot the boom to a position to operate the tool members 14 and 16 to grasp the refuse container 128 when containing refuse, then pivot the boom to the position illustrated in FIG. 5A whereat the refuse container is inverted to dump the refuse contained therein through the bin opening 124 for collection of the refuse in the dump bin 122. The operator 130 can then be operated to pivot the boom 126 to return the emptied refuse container 128 to the position where originally picked up and the tool assembly 10 operated to rotate the first and second tool members 14 and 16 away from each other to release the refuse container.

In the refuse collection embodiment illustrated, the first and second tool members 14 and 16 are each a single tine having an axially inward bend 132 so that the tines of the first and second tool members are each offset axially inward to rotate through adjacent transverse parallel planes approximately midway between the first and second body ends 46 and 48 of the actuator 12.

Figure 5C:
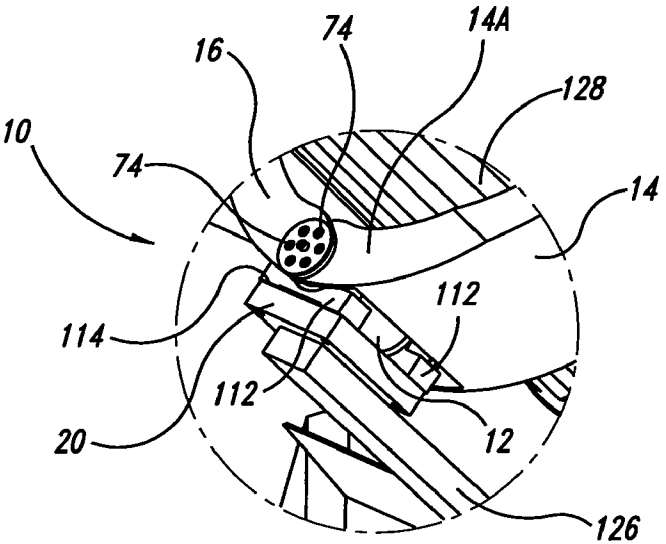
FIG. 5C is an enlarged, sectional view of the area of FIG. 5A encircled by line 5C, showing an alternative design for attachment of the refuse collection tines.

An alternative embodiment of the first and second tool members 14 and 16 usable with the tool assembly 10 for refuse collection is shown in FIG. 5C, with the first and second tool members each straddle mounted to the actuator 12, generally as illustrated in FIG. 8 for the clamshell bucket embodiment. As with the clamshell buckets described above, each of the first and second tool members 14 and 16 has first end attachment portions 14A and 16A axially spaced apart from corresponding second end attachment portions 14B and 16B. The actuator 12 supplies rotary drive to the first attachment portion 14A of the first tool member by the first shaft 50 and rotary drive to the second attachment portion 16B of the second tool member by the second shaft 52. The second attachment portion 14B of the first tool member and the first attachment portion 16A of the second tool member are idle mounted to the second shaft 52 and the first shaft 50, respectively, as described above for the straddle mounting of the clamshell buckets of FIG. 8.

Figure 10:
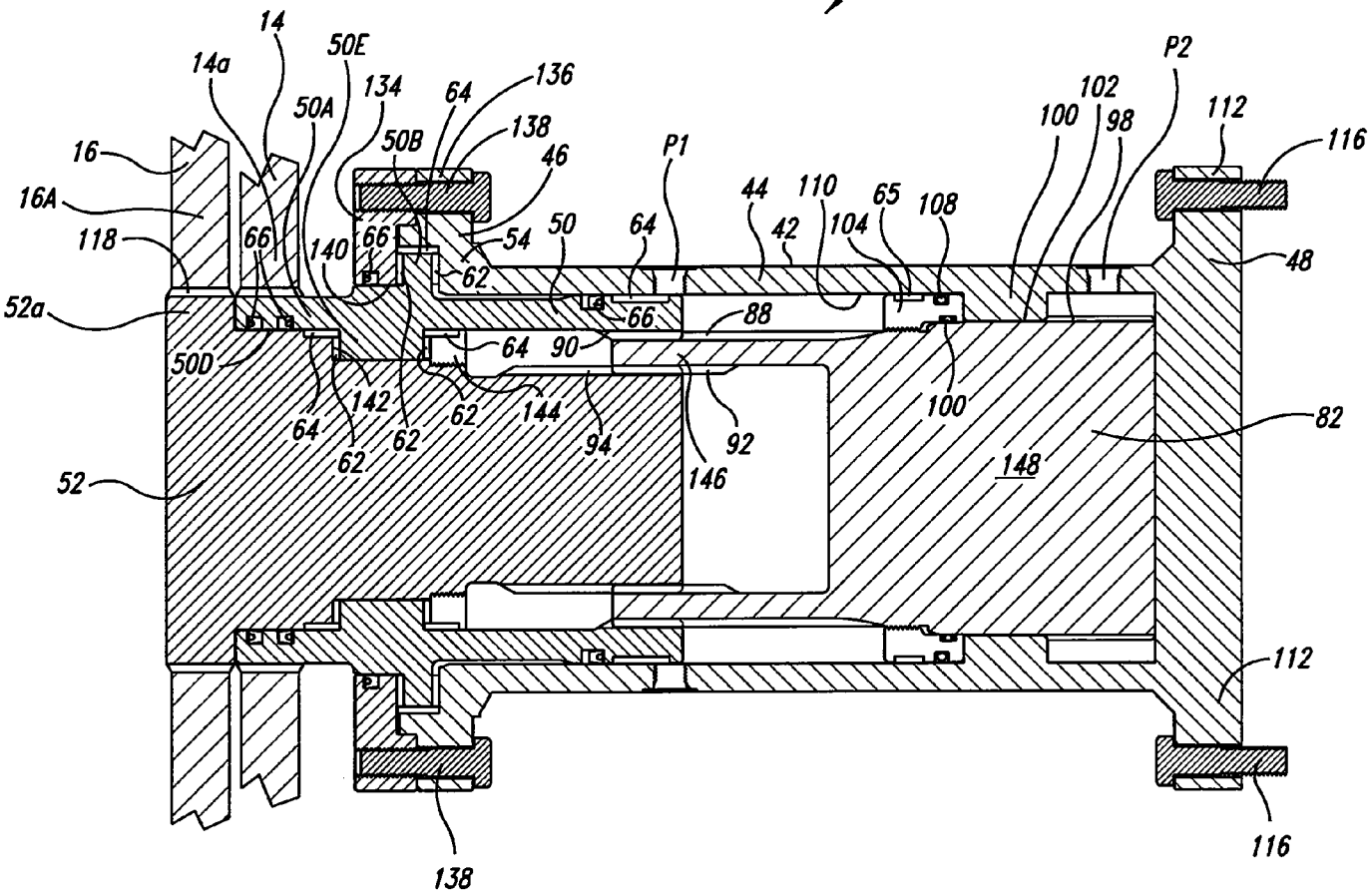
FIG. 10 is a sectional, side elevational view of an alternative embodiment of a fluid-powered rotary actuator embodying the present invention with coaxial timed rotation members showing attachment of two tool members at the same longitudinal end of the actuator.

Another embodiment of the actuator 12, in many ways similar to the embodiment of FIG. 8, is shown in FIG. 10. In this embodiment, the first and second shafts 50 and 52 are located at the first longitudinal body end 46 (the left end as viewed in FIG. 10). The separate first and second shafts 50 and 52 are coaxially positioned within the body 42 and supported for rotation relative to the body 42, with the first shaft 50 being in the form of a sleeve having a central opening 50D extending axially fully therethrough. The second shaft 52 is concentrically, rotatably mounted within the central opening 50D of the first shaft 50. The first shaft 50 extends axially out of the body 42 at the first body end 46, and has an attachment portion 50A at the first body end 46. The second shaft 52 also extends axially out of the body 42 at the first body end 46, extending outward beyond the end of the first shaft 50, and has an attachment portion 52A at the first body end.

The attachment portions 50A and 52A each have splines 118 by which they transmit rotary drive to the attachment portion 14A of the first tool member 14 and to the first attachment portion 16A of the second tool member 16, respectively, rather than using the attachment bolts 74 shown in FIG. 8. Of course, the first attachment portion 14A and the second attachment portion 16A of the first and second tool members 14 and 16 to be used with the actuator 12 will have corresponding mating splines. As noted above, the tool members may comprise various type work tools, including grapples or refuse can collection fingers or tines, to name a few. If the tool members have second attachment members, they may be idle mounted to the actuator body 42 or elsewhere. The actuator of FIG. 10 is particularly desirable for providing rotary drive to the first and second tool members 14 and 16 from the same end of the actuator 12 at adjacent locations.

In the embodiment of the actuator 12 shown in FIG. 10, the first shaft 50 includes a radially outward flange portion 50B, much as with the embodiment of FIG. 8. The outward flange portion 50B is positioned at the first body end 46 adjacent to the axially outward facing first shoulder 54 of the body sidewall 44. The first shaft 50 further includes a radially inward flange portion 50E positioned at the first body end 46. An annular end cap 134 is positioned at the first body end 46 and attached to an end flange 136 of the body 42 by a plurality of bolts 138. The end cap 134 is located axially outward of the outward flange portion 50B of the first shaft 50, with the flange portion 50B positioned between the first shoulder 54 of the body sidewall 44 and the end cap 134 to prevent axial movement of the first shaft within the body 42. The end cap 134 has a central aperture 140 through which the first and second shafts 50 and 52 extend axially outward beyond the end cap.

The second shaft 52 has an axially inward facing shoulder 142 positioned axially outward of the radially inward flange portion 50E of the first shaft 50. An interiorly threaded annular retainer nut 144 is positioned within the body 42, and is threadably attached to an exteriorly threaded portion of the second shaft 52 toward the first body end 46 to position the retainer nut 144 axially inward of the second shaft shoulder 142. The radially inward flange portion 50E of the first shaft 50 is positioned between the second shaft shoulder 142 and the retainer nut 144 to prevent axial movement of the second shaft 52 within the central opening 50D of the first shaft 50, and hence prevent axial movement of the second shaft relative to the body 42. The retainer nut 144 is locked in place for rotation with the second shaft 52.

Much as with the first discussed embodiment, thrust bearings 62 are disposed between the first shaft flange portion 50B of the first shaft 50, and both of the first shoulder 54 of the body sidewall 44 and the end cap 134 to support the first shaft against longitudinal thrust loads. Additionally, thrust bearings 62 are disposed between the radially inward flange portion 50E of the first shaft 50, and both of the second shaft shoulder 142 and the retainer nut 144 to support the second shaft 52 against longitudinal thrust loads. Radial bearing 64 are positioned in this embodiment between the first shaft 50 and the body sidewall 44 and between the radially outward face of the first shaft flange portion 50B and the body sidewall axially outward of the first shoulder 54 to support the first shaft against radial loads. Additionally, radial bearing 64 are positioned between the first and second shafts 50 and 52 and between the retainer nut 144 and the first shaft to support the second shaft against radial loads. Seals 66 are disposed between the first shaft 50 and both the end cap 134 and the body sidewall 44, and between the first and second shafts 50 and 52 to provide a fluid-tight seals therebetween.

The piston 82 used in the actuator 12 of the embodiment of FIG. 10 is coaxially and reciprocally mounted generally within the body 42 coaxial with the first and second shafts 50 and 52. In this embodiment, however, the piston 82 has an annular first end portion 146 toward the first body end 46 in the form of a splined sleeve, and a second end portion 148 toward the second body end 48. An end of the first shaft 50 toward the second body end 48 has inner helical splines 90 over a portion of its length, and spaced apart radially inward thereof, an end of the second shaft 52 has outer helical splines 94 over a portion of its length. The first end sleeve portion 146 of the piston 82 extends within the central opening 50D of the first shaft 50, between the splined ends of the first and second shafts 50 and 52 (radially inward of the first shaft and radially outward of the second shaft). The piston first end sleeve portion 146 has outer helical splines 88 over a portion of its length which mesh with the inner helical splines 90 of the first shaft 50, and inner helical splines 92 over a portion of its length which mesh with the outer helical splines 94 of the second shaft 52. The second end portion 148 of the piston 82 has outer straight splines 98 over a portion of its length which mesh with the interior ring gear portion 100 of the body sidewall 44 having inner straight splines 102. The splines 98 and 102 may be helical if desired. In the actuator 12 of FIG. 10, the annular piston head portion 104 is threadably attached to the second end portion 148 of the piston toward the second body end 48 with the seal 106 disposed therebetween. The seal 108 is disposed between the piston head portion 104 and the smooth interior wall portion 110 of the body sidewall 44 to provide a fluid-tight seal therebetween.

The meshing splines can be threaded in the direction (e.g., left-handed or right-handed, or straight, as appropriate) and with the lead desired to produce simultaneous counter-rotation of the first and second shafts 50 and 52, and hence the first and second tool members 14 and 16 attached thereto, in a desired amount per unit of axial motion of the piston 82, but also may be splined to produce simultaneous rotation of the first and second tool members in the same rotational direction.

As described above for the embodiment of the actuator 12 shown in FIG. 8, reciprocation of the piston 82 within the body 42 occurs when hydraulic oil, air or any other suitable fluid under pressure selectively enters through one or the other of the first port P1 which is in fluid communication with a fluid-tight compartment within the body to a side of the piston head portion 104 toward the first body end 46 or through the second port P2 which is in fluid communication with a fluid-tight compartment within the body to a side of the piston head portion toward the second body end 48. As the piston head portion 104 and the piston 82, of which the piston head portion is a part, linearly reciprocates in an axial direction within the body 42, the outer splines 98 of the piston second end portion 148 engage or mesh with the inner splines 102 of the body sidewall 44 to prevent rotation of the piston, where both the outer splines 98 and the inner splines 102 are straight. The linear movement of the piston 82 is simultaneously transmitted through the outer splines 88 and the inner splines 92 of the piston first end sleeve portion 146 to the inner splines 90 of the first shaft 50 and the outer splines 94 of the second shaft 52, respectively, to cause the shafts to simultaneously rotate. In such manner, the first and second tool members 14 and 16 attached to the first and second shafts simultaneously rotate relative to the body 42 and to the boom mounting member 20 or other mounting surface, platform or frame to which the body is mounted when the piston 82 is moved linearly by the application of fluid pressure to one of the first and second body ports P1 and P2. The smooth interior wall portion 110 of the body sidewall 44 has sufficient axial length to accommodate the full end-to-end reciprocating stroke travel of the piston 82 within the body 42.

As noted above, longitudinal movement of the first and second shafts 50 and 52 is restricted, thus linear movement of the piston 82 is converted into rotational movement of the first and second shafts. The amount of rotation depends on the lead of the various splines and the stroke of the piston, and the output torque produced depends on the slope and direction of turn of the various splines, and the piston force generated by the fluid pressure.

The mounting flanges 112 of the actuator 12 of FIG. 10, by which the body is attached to the mounting face 114 of the boom mounting member 20 or some other mounting surface, platform or frame, are located at the second body end 48 of the body 42. The attachment bolts 116 may be used to accomplish the mounting.

Figure 11:
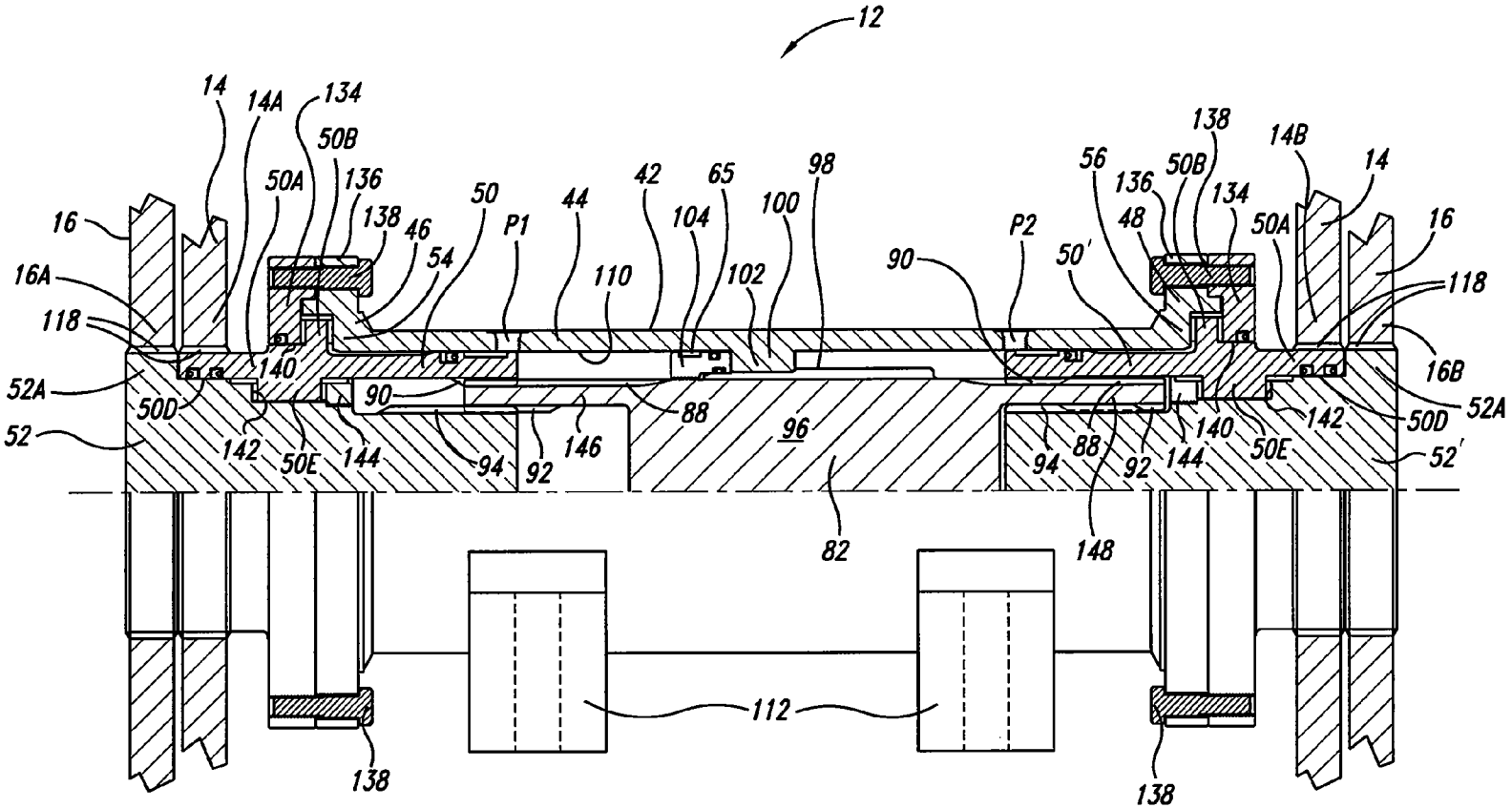
FIG. 11 is a sectional, side elevational view of an alternative embodiment of a fluid-powered rotary actuator embodying the present invention with two timed rotation members showing attachment of two tool members at each of the opposite longitudinal ends of the actuator.

Another embodiment of the actuator 12 is shown in FIG. 11 using straddle mounting but with simultaneous rotary drive provided to the first and second tool members 14 and 16 at both ends of the actuator 12 (i.e., idle mounting is not used). This is useful when it is desirable to provide rotary drive to both the first and second side projecting attachment portions 14A and 14B of the first tool member 14, and to both the first and second side projecting attachment portions 16A and 16B of the second tool member 16. This can be compared to the embodiment of the actuator 12 shown in FIG. 8 where rotary drive is only provided to the first side projecting attachment portion 14A of the first tool member 14 and to the second side projecting attachment portion 16B of the second tool member 16, with the second side projecting attachment portion 14B and the first side projecting attachment portion 16A being idle mounted. For example, with the embodiment of the actuator shown in FIG. 11 used with clamshell buckets, both the right and left sidewalls of each clamshell bucket can be simultaneously supplied torque by the actuator.

Much as described above for the embodiment of FIG. 10, the embodiment of the actuator 12 shown in FIG. 11 has the first and second shafts 50 and 52 located at the first longitudinal body end 46 (the left end as viewed in FIG. 11). The first and second shafts 50 and 52 are described above with respect to the embodiment of FIG. 10 and that description will not be repeated here. However, in the actuator 12 of FIG. 11, similar separate first and second shafts 50' and 52' are also located at the second longitudinal body end 48 (the right end as viewed in FIG. 11), essentially the design described above for the left end of the actuator of FIG. 10 is repeated at the right end of the actuator.

The separate first and second shafts 50' and 52' are coaxially positioned within the body 42 and supported for rotation relative to the body 42, with the first shaft 50' being in the form of a sleeve having a central opening 50D extending axially fully therethrough. The second shaft 52' is concentrically, rotatably mounted within the central opening 50D of the first shaft 50'. The first shaft 50' extends axially out of the body 42 at the second body end 48, and has an attachment portion 50A at the second body end. The second shaft 52' also extends axially out of the body 42 at the second body end 46, extending outward beyond the end of the first shaft 50', and has an attachment portion 52A at the second body end. The attachment portions 50A and 52A each have splines 118 by which they transmit rotary drive to the second attachment portion 14B of the first tool member 14 and to the second attachment portion 16B of the second tool member 16, respectively. Of course, the second attachment portion 14B and the second attachment portion 16B of the first and second tool members 14 and 16 to be used with the actuator 12 will have corresponding mating splines. As noted above, the tool members may comprise various type work tools, including clamshell buckets, brush rakes, grapples or refuse can collection fingers or tines, to name a few.

In the embodiment of the actuator 12 shown in FIG. 11, the first shaft 50' includes a radially outward flange portion 50B, the same as the first shaft 50 described above for the embodiment of FIG. 8. The outward flange portion 50B is positioned at the second body end 48 adjacent to the axially outward facing first shoulder 56 (similar to the first shoulder described with respect to FIG. 8) of the body sidewall 44 located toward the second body end. The first shaft 50' further includes a radially inward flange portion 50E positioned at the second body end 48. An annular end cap 134 is positioned at the second body end 48 and attached to an end flange 136 of the body 42 by a plurality of bolts 138. The end cap 134 is located axially outward of the outward flange portion 50B of the first shaft 50', with the flange portion 50B positioned between the second shoulder 56 of the body sidewall 44 and the end cap 134 to prevent axial movement of the first shaft 50' within the body 42. The end cap 134 has a central aperture 140 through which the first and second shafts 50' and 52' extend axially outward beyond the end cap.

The second shaft 52' has an axially inward facing shoulder 142 positioned axially outward of the radially inward flange portion 50E of the first shaft 50'. An interiorly threaded annular retainer nut 144 is positioned within the body 42, and is threadably attached to an exteriorly threaded portion of the second shaft 52' toward the second body end 48 to position the retainer nut 144 axially inward of the second shaft shoulder 142 of the second shaft 52'. The radially inward flange portion 50E of the first shaft 50' is positioned between the second shaft shoulder 142 of the second shaft 52' and the retainer nut 144 to prevent axial movement of the second shaft 52' within the central opening 50D of the first shaft 50', and hence prevent axial movement of the second shaft 52' relative to the body 42. The retainer nut 144 is locked in place for rotation with the second shaft 52'. As with the first and second shafts 50 and 52 described with respect to FIG. 10, thrust bearings 62, radial bearing 64 and seals 66 are provided.

The piston 82 used in the actuator 12 of the embodiment of FIG. 11 is coaxially and reciprocally mounted generally within the body 42 coaxial with the first and second shafts 50 and 52 at the first body end 46 and with the first and second shafts 50' and 52' at the second body end 48. In this embodiment, however, not only does the piston 82 have the annular first end portion 146 toward the first body end 46 in the form of a splined sleeve, but the second end portion 148 toward the second body end 48 is also in the form of a splined sleeve. The first and second shafts 50 and 52 are described above with respect to the embodiment of FIG. 10 and that description will not be repeated here. With respect to the first shaft 50' at the second body end 48, it has an end toward the first body end 46 with inner helical splines 90 over a portion of its length, and spaced apart radially inward thereof, the second shaft 52' has an end with outer helical splines 94 over a portion of its length. The second end sleeve portion 148 of the piston 82 extends within the central opening 50D of the first shaft 50', between the splined ends of the first and second shafts 50' and 52' (radially inward of the first shaft 50' and radially outward of the second shaft 52'). The second end sleeve portion 148 has outer helical splines 88 over a portion of its length which mesh with the inner helical splines 90 of the first shaft 50', and inner helical splines 92 over a portion of its length which mesh with the outer helical splines 94 of the second shaft 52'. As in the embodiment of the actuator 12 shown in FIG. 8, the mid-portion 96 of the piston 82 has outer straight splines 98 over a portion of its length which mesh with inner straight splines 102 of the interior ring gear portion 100 of the body sidewall 44. Alternatively, the splines 98 and 102 may be helical. The annular piston head portion 104 of the actuator 12 is threadably attached to the mid-portion 96 of the piston 82.

Reciprocation of the piston 82 within the body 42 occurs when hydraulic oil, air or any other suitable fluid under pressure selectively enters through one or the other of the first port P1 which is in fluid communication with a fluid-tight compartment within the body to a side of the piston head portion 104 toward the first body end 46 or through the second port P2 which is in fluid communication with a fluid-tight compartment within the body to a side of the piston head portion toward the second body end 48. As the piston head portion 104 and the piston 82 linearly reciprocates in an axial direction within the body 42, the outer splines 98 of the piston mid-portion 96 engage or mesh with the inner splines 102 of the body sidewall 44 to prevent rotation of the piston, where both the outer splines 98 and the inner splines 102 are straight. The linear and rotational movement of the piston 82 is simultaneously transmitted through the outer splines 88 and the inner splines 92 of the piston first end sleeve portion 146 to the inner splines 90 of the first shaft 50 and the outer splines 94 of the second shaft 52, respectively, and simultaneously transmitted through the outer splines 88 and the inner splines 92 of the piston second end sleeve portion 148 to the inner splines 90 of the first shaft 50' and the outer splines 94 of the second shaft 52', respectively, to cause the first and second shafts 50 and 52 and the first and second shafts 50' and 52' to all simultaneously rotate. The splines are selected to cause the first shafts 50 and 50' to rotate in the same direction, and the second shafts 52 and 52' to rotate in the same direction, but typical opposite or counter to the direction of rotation of the first shafts so that the first and second tool members 14 and 16 attached to the shafts selectively rotate toward and away from each other. The shafts rotate relative to each other and each rotates relative to the body 42 and the boom mounting member 20 or other mounting surface, platform or frame to which the body is mounted when the piston 82 is moved linearly by the application of fluid pressure to one of the first and second body ports P1 and P2.

The longitudinal movement of the first and second shafts 50 and 52 and the first and second shafts 50' and 52' is restricted, thus linear movement of the piston 82 is converted into rotational movement of the shafts.

As with the embodiment of FIG. 8, the mounting flanges 112 of the actuator 12 of FIG. 11, by which the body is attached to the mounting face 114 of the boom mounting member 20 or some other mounting surface, platform or frame, are located along the body sidewall 44.

Figure 12:
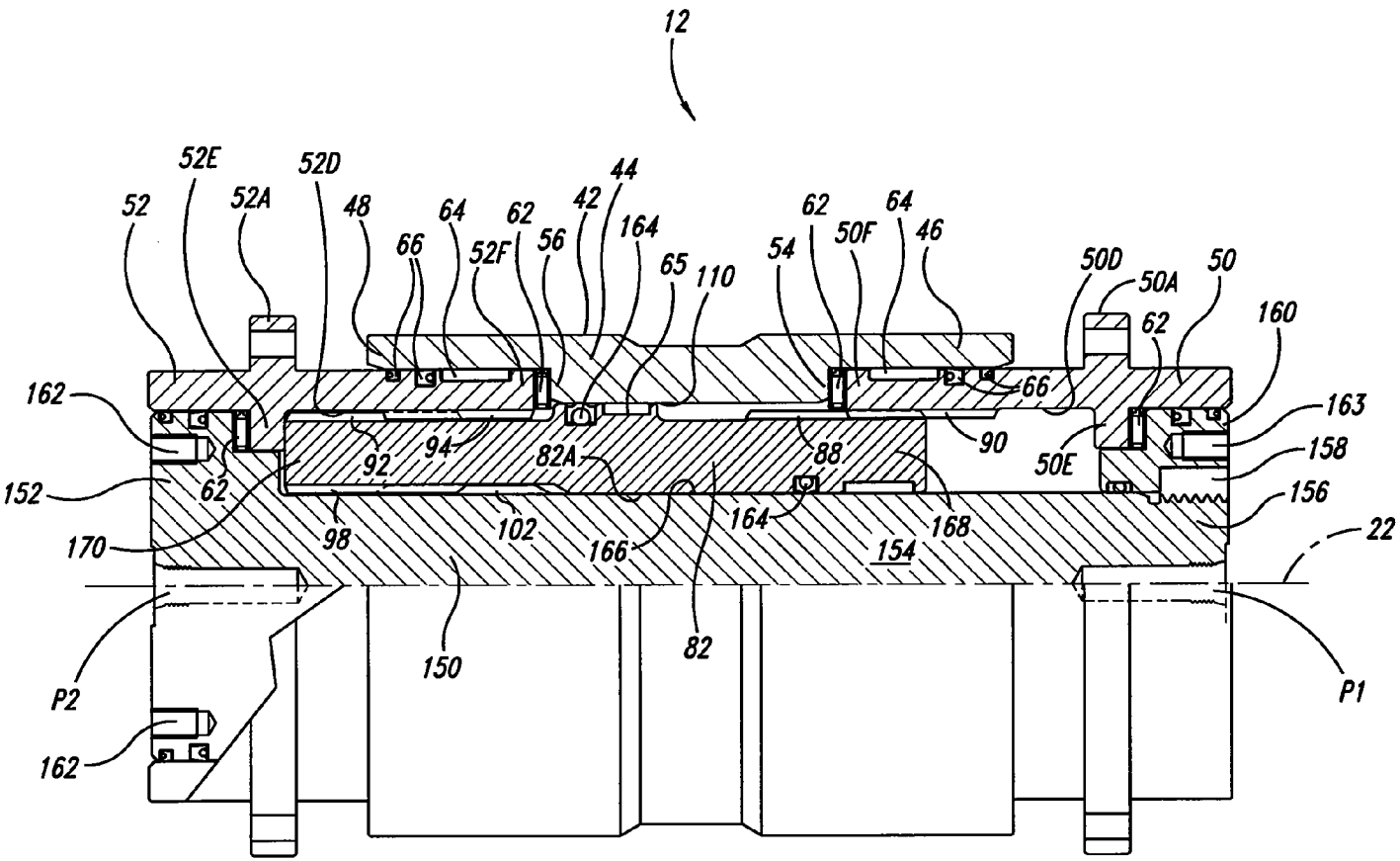
FIG. 12 is a sectional, side elevational view of an alternative embodiment of a fluid-powered rotary actuator embodying the present invention with timed rotation members for attachment of tool members at opposite longitudinal ends of the actuator and utilizing a central tie rod member.

Yet another embodiment of the actuator 12 is shown in FIG. 12. This embodiment is similar to the embodiment of FIG. 8 with the first and second shafts 50 and 52 located at the first and second ends 46 and 48, respectively, of the body 42. However, rather than using first and second retainer nuts 58 and 60 to retain the shafts within the body 42 against axial movement, the body 42 of the actuator 12 includes a central tie rod 150 positioned along the longitudinal axis 22 of the actuator. The first and second shafts 50 and 52 are in the form of sleeves having central openings 50D and 52D, respectively, extending axially fully therethrough, and have the tie rod 150 extending through the central openings. The tie rod 150 retains the first and second shafts 50 and 52 from axially outward movement relative to each other and the body sidewall 44, as will be described below.

As with other embodiments, the first and second shafts 50 and 52 are coaxially positioned within the body 42 and supported for rotation relative to the body. The first shaft 50 extends axially out of the body 42 at the first body end 46, and has an attachment portion 50A in the form of a flange located axially outward of the first body end 46 to which the first tool member 14 may be connected. The second shaft 52 extends axially out of the body 42 at the second body end 48, and has an attachment portion 52A in the form of a flange located axially outward of the second body end 48 to which the second tool member 16 may be connected. The first shaft 50 further includes an axially inward facing end wall portion 50F positioned within the body 42 inward of the first body end 46 adjacent to the axially outward facing first shoulder 54 of the body sidewall 44 to prevent axial inward movement of the first shaft 50. Similarly, the second shaft 52 further includes an axially inward facing end wall portion 52F positioned within the body 42 inward of the second body end 48 adjacent to the axially outward facing second shoulder 56 of the body sidewall 44 to prevent axial inward movement of the second shaft 52.

The first and second shafts 50 and 52 each further include a radially inward flange portion 50E and 52E, respectively. The radially inward flange portion 50E is positioned axially outward of the first body end 46, and the radially inward flange portion 52E is positioned axially outward of the second body end 48. The tie rod 150 includes a head portion 152 positioned axially outward of the radially inward flange portion 52E of the second shaft 52 and adjacent thereto to prevent axial outward movement of the second shaft 52. The tie rod 150 further includes an elongated shaft portion 154 extending along the longitudinal axis 22 of the actuator 12 and having an exteriorly threaded end portion 156 positioned axially outward of the radially inward flange portion 50E of the first shaft 50. A tie rod retainer nut 158 is threadably attached to the tie rod threaded end portion 156. An annular end cap 160 is positioned axially outward of the radially inward flange portion 50E of the first shaft 50 and adjacent thereto to prevent axial outward movement of the first shaft 50. The end cap 160 has a central aperture through which the tie rod shaft portion 154 extends axially outward beyond the end cap. The tie rod retainer nut 158 prevents axial outward movement of the end cap 160. The tie rod retainer nut 158 is locked in place against rotation on the tie rod threaded end portion. As with the embodiments described above, thrust bearings 62, radial bearing 64 and seals 66 are provided.

The actuator 12 of FIG. 12 is attached to the mounting face 114 of the boom mounting member 20 or some other mounting surface, platform or frame by attachment of the tie rod 150 thereto using mounting flanges (not shown). The mounting flanges are connected to the tie rod 150 by attachment bolts threadably received in a plurality of threaded apertures 162 in the end of the tie rod head portion 152 and in a plurality of threaded apertures 163 in the tie rod end cap 160.

The piston 82 used in the actuator 12 of the embodiment of FIG. 12 is in the form of a piston sleeve having a central opening 82A extending axially fully therethrough, with the tie rod shaft portion 154 extending through the central opening 82A. The piston 82 is coaxially and reciprocally mounted generally within the body 42 coaxial with the first and second shafts 50 and 52. Instead of using a threadably attached annular piston head portion as in the embodiments described above, the actuator 12 of FIG. 12 integrates the piston head function into the sleeve by providing seals 164 carried by the piston 82 between the exterior and interior walls thereof and the smooth interior wall portion 110 of the body sidewall 44 and a smooth exterior wall portion 166 of the tie rod shaft portion 154 to provide fluid-tight seals therebetween.

In the embodiment of FIG. 12, the piston 82 has a first end portion 168 toward the first body end 46, and a second end portion 170 toward the second body end 48. An end of the first shaft 50 toward the second body end 48 has inner helical splines 90 over a portion of its length, and an end of the second shaft 52 toward the first body end 46 has inner helical splines 94 over a portion of its length. The first end sleeve portion 168 of the piston 82 extends within the central opening 50D of the first shaft 50, and has outer helical splines 88 over a portion of its length, which mesh with the inner helical splines 90 of the first shaft 50. The second end sleeve portion 170 of the piston 82 extends within the central opening 52D of the second shaft 52, and has outer helical splines 92 over a portion of its length which mesh with the inner helical splines 94 of the second shaft 52. Unlike the previously described embodiments with the body sidewall having a splined interior ring gear portion, in the embodiment of FIG. 12 the tie rod shaft portion 154 (forming a part of the body 42) has outer straight splines 102 at its end toward the second body end 48. The piston 82, within the central opening 82A thereof at an end toward the second body end 48, has inner straight splines 98 over a portion of its length that mesh with the outer straight splines 102 of the tie rod shaft portion 154. The splines 98 and 102 may be helical if desired.

As before, the meshing splines can be threaded in the direction (e.g., left-handed or right-handed) and with the lead desired to produce simultaneous counter-rotation of the first and second shafts 50 and 52, and hence the first and second tool members 14 and 16 attached thereto, in a desired amount per unit of axial motion the piston 82, but also may be splined to produce simultaneous rotation of the first and second tool members in the same rotational direction.

As described above for other embodiments of the actuator 12, reciprocation of the piston 82 within the body 42 occurs when hydraulic oil, air or any other suitable fluid under pressure selectively enters through one or the other of the first port P1 which is in fluid communication with a fluid-tight compartment within the body toward the first body end 46 or through the second port P2 which is in fluid communication with a fluid-tight compartment within the body toward the second body end 48. In the embodiment of FIG. 12, the first and second ports P1 and P2 are formed in the tie rod 150 at the ends thereof toward the first and second shafts 50 and 52, respectively. As the piston 82 linearly reciprocates in an axial direction within the body 42, the inner splines 98 of the piston 82 engage or mesh with the outer splines 102 of the tie rod shaft portion 154 to prevent rotation of the piston, where both the inner splines 98 and the outer splines 102 are straight. The linear movement of the piston 82 is simultaneously transmitted through the outer splines 88 and 92 of the piston to the inner splines 90 of the first shaft 50 and the inner splines 94 of the second shaft 52, respectively, to cause the shafts to simultaneously rotate. In such manner, the first and second tool members 14 and 16 attached to the first and second shafts simultaneously rotate relative to the tie rod 150 (which forms a part of the body 42) and to the boom mounting member 20 or other mounting surface, platform or frame to which the body/tie rod is mounted when the piston 82 is moved linearly by the application of fluid pressure to one of the first and second ports P1 and P2. The smooth interior wall portion 110 of the body sidewall 44 has sufficient axial length to accommodate the full end-to-end reciprocating stroke travel of the piston 82 within the body 42.

Since longitudinal movement of the first and second shafts 50 and 52 is restricted, linear movement of the piston 82 is converted into rotational movement of the first and second shafts.

Figure 13B:
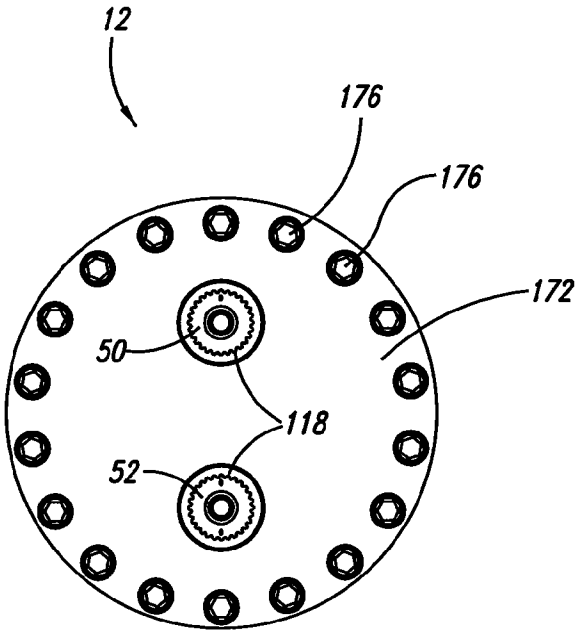
FIG. 13B is an end view of the actuator of FIG. 13A.
Figure 13A:
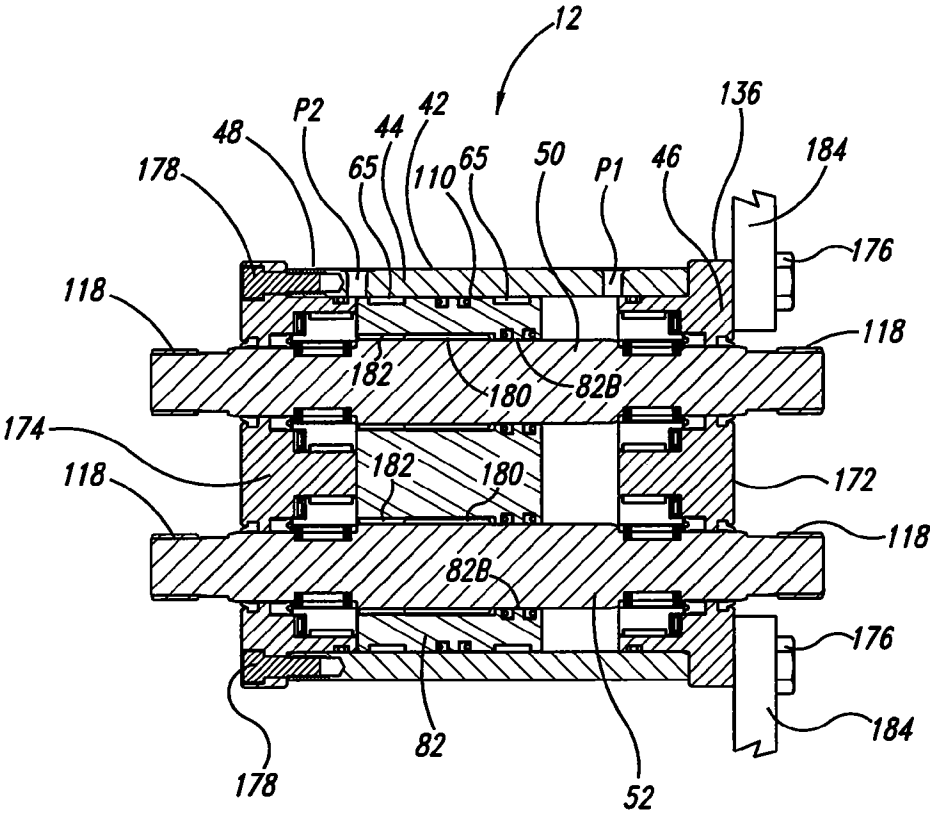
FIG. 13A is a sectional, side elevational view of an alternative embodiment of a fluid-powered rotary actuator embodying the present invention with two laterally separated timed rotation members.

Another embodiment of the actuator 12 is shown in FIGS. 13A and 13B using straddle mounting with simultaneous rotary drive provided to the first and second tool members 14 and 16 at both ends of the actuator 12. In this embodiment, first and second end caps 172 and 174 are positioned at the first and second body ends 46 and 48. The first end cap 172 is attached to the end flange 136 of the body 42 by a plurality of bolts 176. The second end cap is attached to the body sidewall 44 at the second body end 48 by a plurality of bolts 178. The first and second shafts 50 and 52 each extends fully between the first and second end caps 172 and 174, and each has first and second end portions with splines 118 extending axially beyond the first and second end caps to receive and provide rotary drive to the first and second tool members 14 and 16 (not shown in FIGS. 13A and 13B) at positions axially outward of the end caps. The first and second end portions of the first shaft 50 both simultaneously supply torque to the first tool member 14, and first and second end portions of the second shaft 52 both simultaneously supply torque to the second tool member 16. The first and second shafts 50 and 52 are in laterally spaced apart relation, each mounted in the body 42 for rotation on a separate axis of rotation not coaxial with the other or the body.

The piston 82 of the embodiment of FIGS. 13A and 13B has two apertures 82B therethrough. Each piston aperture 82B has one of the first and second shafts 50 and 52 extending therethrough. The portion of each of the first and second shafts 50 and 52 extending through the piston aperture 82B has outer helical splines 180 over a portion of its length which mesh with inner helical splines 182 of the piston 82 formed within the piston aperture. While the piston may also be supplied with outer splines arranged to mesh with the splines of an interior ring gear portion of the body sidewall 44 as used with some of the previously described embodiments, such is not necessary to achieve operation of the actuator 12 unless required to reduce binding during operation of the actuator. As with the embodiments described above, thrust bearings, radial bearing and seals are provided as needed. The body 42 is shown in FIG. 13A mounted to a mounting frame 184 located at the first body end 46. Alternatively, the actuator 12 may be mounted using mounting flanges attached to the body sidewall 44 of the body 42 as described above for other embodiments.

Reciprocation of the piston 82 within the body 42 occurs when hydraulic oil, air or any other suitable fluid under pressure selectively enters through one or the other of the first port P1 which is in fluid communication with a fluid-tight compartment within the body toward the first body end 46 or through the second port P2 which is in fluid communication with a fluid-tight compartment within the body toward the second body end 48. As the piston 82 linearly reciprocates in an axial direction within the body 42, the inner splines 182 of the piston 82 located within the piston apertures 82B engage or mesh with the outer splines 180 of the first and second shafts 50 and 52 to cause rotation of the first and second shafts. Since the first and second shafts 50 and 52 are laterally spaced apart, the piston 82 cannot rotate as it moves longitudinally within the body 42. As such, and since longitudinal movement of the first and second shafts 50 and 52 is restricted, the linear movement of the piston is simultaneously transmitted through the inner splines 182 of the piston to the outer splines 180 of the shafts to cause the shafts to simultaneously rotate. In such manner, the first and second tool members 14 and 16 (not shown in FIGS. 13A and 13B) attached to the first and second shafts simultaneously rotate relative to the body 42 and to the mounting frame 184 to which the body is mounted when the piston 82 is moved linearly by the application of fluid pressure to one of the first and second ports P1 and P2.

Figure 14B:
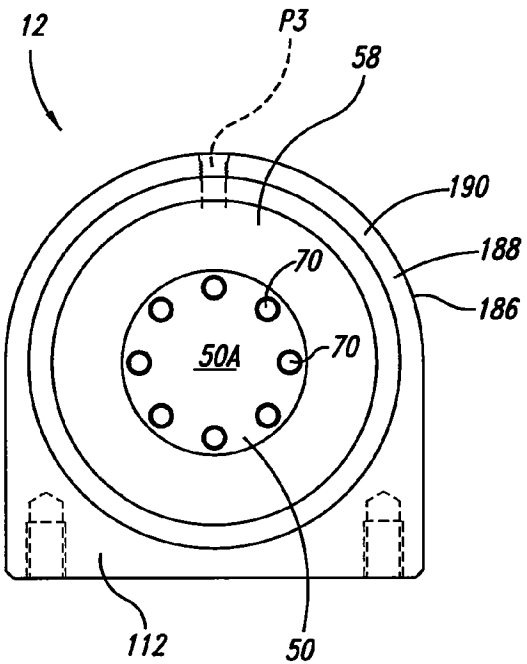
FIG. 14B is an end view of the actuator of FIG. 14A.
Figure 14A:
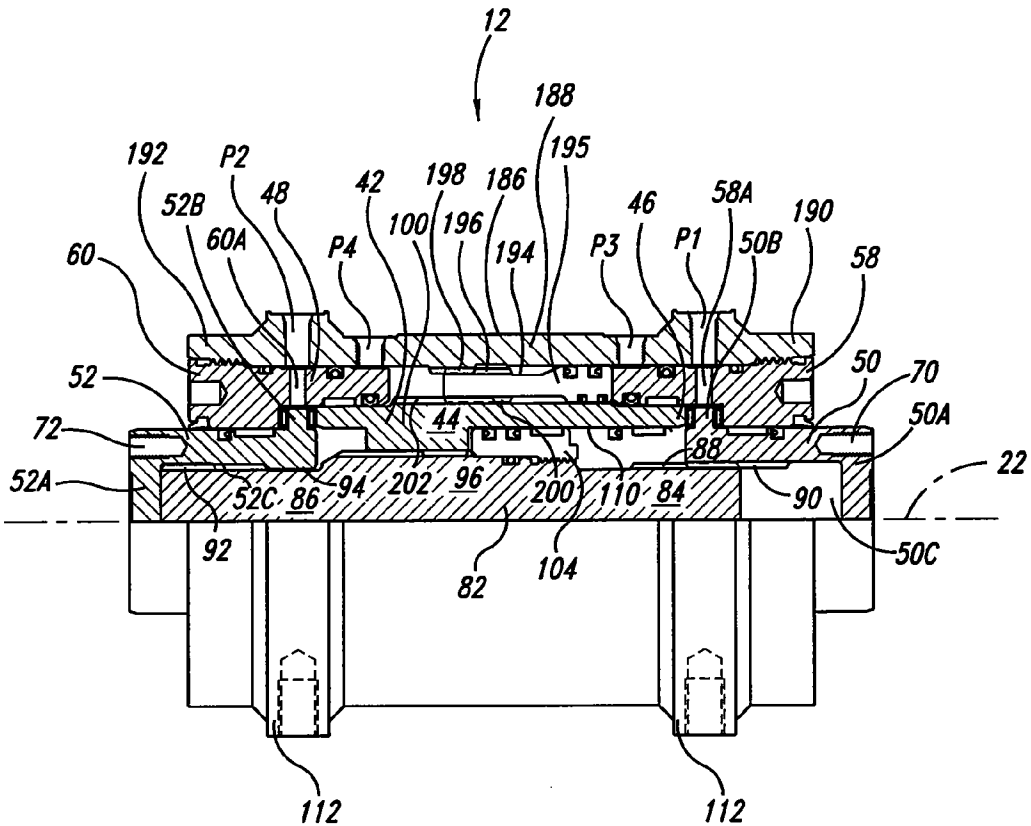
FIG. 14A is a sectional, side elevational view of an alternative embodiment of a fluid-powered rotary actuator embodying the present invention with radially inward positioned timed rotation members for attachment of tool members at opposite longitudinal ends of the actuator and a radially outward positioned rotation member.

Another embodiment of the actuator 12 is shown in FIGS. 14A and 14B. This actuator is essentially the actuator of FIG. 8, referred to here as the inner actuator, usable to provide simultaneous rotary drive to the first and second tool members 14 and 16 (not shown in FIGS. 14A and 14B) such as to rotate the first and second tool members toward and away from each other to provide a grabbing action, positioned within a rotary actuator, referred to here as the outer actuator, that is operable to rotate the inner actuator and the first and second tool members as a unit, as will be described below.

In particular, the actuator 12 has an elongated outer housing or body 186 with a cylindrical sidewall 188 and first and second longitudinal ends 190 and 192, respectively. The outer body 186 has the mounting flanges 112 for mounting of the body the mounting face 114 of the boom mounting member 20 or some other mounting surface, platform or frame. The body 42 of the inner actuator, described above for the actuator of FIG. 8 and referred to here as the inner body 42, is positioned coaxially within the outer body 186. The inner and outer bodies 42 and 186 are arranged coaxial with the longitudinal axis 22. As with the actuator of FIG. 8, the separate first and second end rotatable drive shafts 50 and 52 of the inner actuator are coaxially positioned within the inner body 42 and supported for rotation relative to the inner body, with the first shaft 50 extending axially out of the inner body 42 at the first body end 46, and the second shaft 52 extending axially out of the inner body 42 at the second body end 48. For brevity, the complete physical description of the inner actuator will not be repeated here.

In the embodiment of the actuator 12 of FIGS. 14A and 14B, the exteriorly threaded first annular retainer nut 58 is positioned between the inner and outer bodies 42 and 186, at the first body ends 46 and 190, and is threadably attached to an interiorly threaded portion of the body sidewall 188 of the outer body 186 at the first body end 190. Similarly, the exteriorly threaded first annular retainer nut 60 is positioned between the inner and outer bodies 42 and 186, at the second body ends 48 and 192, and is threadably attached to an interiorly threaded portion of the body sidewall 188 of the outer body 186 at the second body end 192. In this embodiment of the actuator, the first and second retainer nuts 58 and 60 are located axially outward of the axially outward facing ends of the first and second body ends 46 and 48 of the body sidewall 44, with the flange portion 50B of the first shaft 50 positioned between the axially outward facing end of the first body end 46 and the first retainer nut 58 to prevent axial movement of the first shaft within the inner body 42, and with the flange portion 52B of the second shaft 52 positioned between the axially outward facing end of the second body end 48 and the second retainer nut 60 to prevent axial movement of the second shaft within the inner body 42.

The exterior end surfaces of the attachment portions 50A and 52A of the first and second shafts 50 and 52 are flat and each have threaded apertures 70 and 72 to allow attachment of the first and second tool members 14 and 16 thereto. The first and second end support members 76 and 78 described above for the actuator of FIG. 8 may be used to idle mount one of the attachment portions of the first and second tool members if desired to achieve a straddle mounting of the first and second tool members 14 and 16 to the actuator 12 of FIGS. 14A and 14B.

The construction and operation of the inner actuator is generally as described above for the actuator of FIG. 8, with reciprocation of the piston 82 within the inner body 42 occuring when hydraulic oil, air or any other suitable fluid under pressure selectively enters through one or the other of a first port P1 which is in fluid communication with a fluid-tight compartment within the inner body 42 to a side of the piston head portion 104 toward the first body end 46 or through a second port P2 which is in fluid communication with a fluid-tight compartment within the inner body 42 to a side of the piston head portion toward the second body end 48. It is noted that in the actuator 12 of FIGS. 14A and 14B, the first and second ports P1 and P2 extend through the outer body 186, toward the first and second body ends 190 and 192 thereof, respectively, and communicate with the fluid-tight compartments within the inner body 42 though channels 58A and 60A in the retainer nuts 58 and 60, respectively. As the piston head portion 104 and the piston 82, of which the piston head portion is a part, linearly reciprocates in an axial direction within the inner body 42, the outer splines 98 of the piston mid-portion 96 engage or mesh with the inner splines 102 of the body sidewall 44 to prevent rotation of the piston, where both the outer splines 98 and the inner splines 102 are straight. Helical splines 98 and 102 may be used if desired. The linear movement of the piston 82 is simultaneously transmitted through the outer splines 88 and 92 of the piston to the inner splines 90 and 94, respectively, of the first and second shafts 50 and 52 to cause the shafts to simultaneously rotate. Since the longitudinal movement of the first and second shafts 50 and 52 is restricted, linear movement of the piston 82 is converted into rotational movement of the first and second shafts.

The actuator 12 of FIGS. 14A and 14B further includes an elongated, annular splined outer piston 194 positioned within the annular space between the inner body 42 and the outer body 186 for axial reciprocal movement within the outer body 186 coaxial with the inner body 42 and first and second shafts 50 and 52. The outer piston 194 has an annular piston head portion 195. The outer piston 194 further includes outer helical splines 196 over a portion of its length which mesh with inner helical splines 198 of the outer body sidewall 188 (formed on a radially inward facing side thereof), and inner straight splines 200 over a portion of its length which mesh with outer straight splines 202 of the inner body sidewall 44 (formed on a radially outward facing side thereof). The splines 200 and 202 may be helical if desired. Alternatively, the splines 196 and 198 may be straight and the splines 200 and 202 helical, or the splines 196 and 198 may be helical and the splines 200 and 202 straight. The meshing splines can be threaded in the direction (e.g., left-handed or right-handed, or straight, as appropriate) and with the lead desired to produce rotation of the inner actuator (including the inner body 42, the first and second shafts 50 and 52, and the first and second tool members 14 and 16 attached to the shafts as a unit) relative to the outer body 188 in a desired amount per unit of axial motion of the outer piston 194. As with the embodiments described above, thrust bearings, radial bearing and seals are provided as needed.

Reciprocation of the outer piston 194 within the outer body 186 occurs when hydraulic oil, air or any other suitable fluid under pressure selectively enters through one or the other of a third port P3 which is in fluid communication with a fluid-tight compartment within the outer body 186 to a side of the piston head portion 195 toward the first body end 190 or through a fourth port P4 which is in fluid communication with a fluid-tight compartment within the outer body 186 to a side of the piston head portion 195 toward the second body end 192. As the piston head portion 195 and the outer piston 194 linearly reciprocates in an axial direction within the outer body 186, the outer splines 196 of the outer piston 194 engage or mesh with the inner splines 198 of the outer body sidewall 188 to cause rotation of the outer piston, where both the outer splines 196 and the inner splines 198 are helical. The rotational movement of the outer piston 194 is transmitted through the inner splines 200 of the outer piston to the outer splines 202 of the inner body sidewall 44 of the inner body 42 to cause the inner body, and the first and second shafts 50 and 52, to rotate as a unit relative to the outer body 186. In such manner, the first and second tool members 14 and 16 attached to the first and second shafts 50 and 52 rotate relative to the outer body 186 and to the boom mounting member 20 or other mounting surface, platform or frame to which the outer body is mounted when the outer piston 194 is moved linearly by the application of fluid pressure to one of the third and fourth ports P3 and P4. By way of example using grapples as the first and second tool members 14 and 16, the resulting movement by operation of the inner actuator is timed rotation of the grapple tines about the axis 22 serving much like grabbing with the fingers of a hand, and the resulting movement by operation of the outer actuator is rotation of the grapple tines as a unit about the axis 22 much like the rotation of a wrist to provide a high torque articulated tool.

Figure 15:
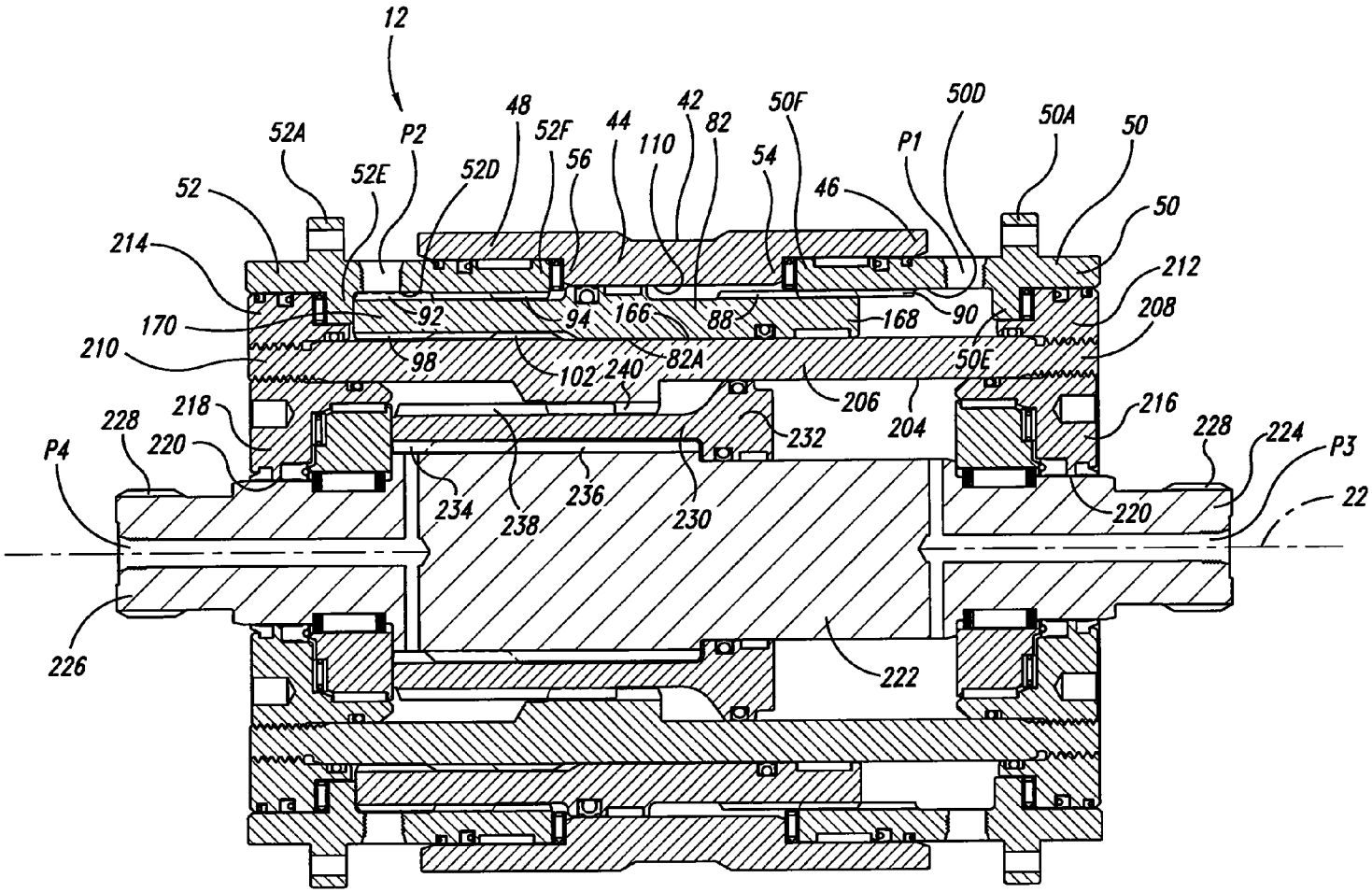
FIG. 15 is a sectional, side elevational view of another alternative embodiment of a fluid-powered rotary actuator embodying the present invention with radially outward positioned timed rotation members for attachment of tool members at opposite longitudinal ends of the actuator and a radially inward positioned rotation member.

Another embodiment of the actuator 12 is shown in FIG. 15. This actuator is essentially the actuator of FIG. 12 (although without the tie rod) referred to here as the outer actuator usable to provide simultaneous rotary drive to the first and second tool members 14 and 16 (not shown in FIG. 15) such as to rotate the first and second tool members toward and away from each other to provide a grabbing action, with a rotary actuator referred to here as the inner actuator positioned within the outer actuator. The inner actuator is operable to rotate the outer actuator and the first and second tool members as a unit.

In particular, rather than using the central tie rod of the embodiment of FIG. 12, the actuator 12 of FIG. 15 has an elongated inner housing or body 204 with a cylindrical sidewall 206 and first and second longitudinal ends 208 and 210, respectively. The inner body 204 is positioned coaxially within the body 42, described above for the actuator of FIG. 12 and referred to here as the outer body 42. The outer and inner bodies 42 and 204 are arranged coaxial with the longitudinal axis 22. As with the actuator of FIG. 12, the separate first and second end rotatable drive shafts 50 and 52 of the outer actuator are in the form of sleeves and are coaxially positioned within the outer body 42 and supported for rotation relative to the outer body, with the first shaft 50 extending axially out of the outer body 42 at the first body end 46, and the second shaft 52 extending axially out of the outer body 42 at the second body end 48. For brevity, the complete physical description of the outer actuator will not be repeated here.

In the actuator 12 of FIG. 15, the axially inward facing end wall portion 50F of the first shaft 50 is positioned within the outer body 42 inward of the first body end 46 adjacent to the axially outward facing first shoulder 54 of the body sidewall 44 to prevent axial inward movement of the first shaft 50. Similarly, the axially inward facing end wall portion 52F of the second shaft 52 is positioned within the outer body 42 inward of the second body end 48 adjacent to the axially outward facing second shoulder 56 of the body sidewall 44 to prevent axial inward movement of the second shaft 52.

The radially inward flange portion 50E of the first shaft 50 is positioned axially outward of the first body end 46, and the radially inward flange portion 52E of the second shaft 52 is positioned axially outward of the second body end 48. The inner body 204 has first and second annular retainer nuts 212 and 214 threadably attached to outer threaded portions of the first and second body ends 208 and 210, respectively, of the inner body. The retainer nut 212 is positioned axially outward of the radially inward flange portion 50E of the first shaft 50 and adjacent thereto to prevent axial outward movement of the first shaft 50. The retainer nut 214 is positioned axially outward of the radially inward flange portion 52E of the second shaft 52 and adjacent thereto to prevent axial outward movement of the second shaft 52.

The attachment portion 50A of the first shaft 50 is in the form of a flange located axially outward of the first body end 46 to which the first tool member 14 may be connected. The attachment portion 52A of the second shaft 52 is in the form of a flange located axially outward of the second body end 46 to which the second tool member 16 may be connected.

The inner body 204 further has third and fourth annular retainer nuts 216 and 218 threadably attached to inner threaded portions of the first and second body ends 208 and 210, respectively, of the inner body. The third and fourth retainer nuts 216 and 218 each has a central aperture 220 through which a shaft 222 extends for positioning the shaft 222 along the longitudinal axis 22 of the inner actuator within the inner body 204. The shaft 222 has first and second end portions 224 and 226 that extend axially outward beyond the third and fourth retainer nuts 216 and 218, respectively. The first and second end portions 224 and 226 of the shaft 222 have splines 228 by which the shaft 222 may be attached to a mounting surface, platform or frame.

The construction and operation of the outer actuator is generally as described above for the actuator of FIG. 12, with reciprocation of the piston 82 within the outer body 42 occurring when hydraulic oil, air or any other suitable fluid under pressure selectively enters through one or the other of a first port P1 which is in fluid communication with a fluid-tight compartment within the outer body 42 toward the first body end 46 or through a second port P2 which is in fluid communication with a fluid-tight compartment within the outer body 42 toward the second body end 48. It is noted that in the actuator 12 of FIG. 15, the first and second ports P1 and P2 extend through the first and second shafts 50 and 52. As the piston 82 linearly reciprocates in an axial direction within the outer body 42, the inner splines 98 of the piston engage or mesh with outer splines 102 of the inner body 204 (formed on a radially outward facing side thereof) to prevent rotation of the piston, where both the inner splines 98 and the outer splines 102 are straight. The splines 98 and 102 may be helical if desired. The linear movement of the piston 82 is simultaneously transmitted through the outer splines 88 and 92 of the piston to the inner splines 90 and 94, respectively, of the first and second shafts 50 and 52 to cause the shafts to simultaneously rotate. Since the longitudinal movement of the first and second shafts 50 and 52 is restricted, linear movement of the piston 82 is converted into rotational movement of the first and second shafts.

The actuator 12 of FIG. 15 further includes an elongated, annular splined inner piston 230 positioned within the annular space between the inner body 204 and the shaft 222 for axial reciprocal movement within the inner body 204 coaxial with the outer body 42 and the first and second shafts 50 and 52. The inner piston 230 has an annular piston head portion 232. The inner piston 230 further includes inner helical splines 234 over a portion of its length which mesh with outer helical splines 236 of the shaft 222, and outer helical splines 238 over a portion of its length which mesh with inner helical splines 240 of the inner body sidewall 206 of the inner body 204 (formed on a radially outward facing side thereof). The meshing splines can be threaded in the direction (e.g., left-handed or right-handed) and with the lead desired to produce rotation of the outer actuator (including the outer body 42, the first and second shafts 50 and 52, and the first and second tool members 14 and 16 attached to the shafts as a unit) relative to the inner body 204 in a desired amount per unit of axial motion of the inner piston 230. As with the embodiments described above, thrust bearings, radial bearing and seals are provided as needed.

Reciprocation of the inner piston 230 within the inner body 204 occurs when hydraulic oil, air or any other suitable fluid under pressure selectively enters through one or the other of a third port P3 which is in fluid communication with a fluid-tight compartment within the inner body 204 to a side of the piston head portion 232 toward the first body end 208 or through a fourth port P4 which is in fluid communication with a fluid-tight compartment within the inner body 204 to a side of the piston head portion 232 toward the second body end 210. As the piston head portion 232 and the inner piston 230 linearly reciprocates in an axial direction within the inner body 204, the inner splines 234 of the inner piston 230 engage or mesh with the outer splines 236 of the shaft 222 to cause rotation of the inner piston, where both the inner splines 234 and the outer splines 236 are helical. The linear and rotational movement of the inner piston 230 is transmitted through the outer splines 238 of the inner piston to the inner splines 240 of the inner body sidewall 206 of the inner body 204 to cause the inner body, which carries the outer body 42 and the first and second shafts 50 and 52 therewith, to rotate as a unit relative to the shaft 222. In such manner, the first and second tool members 14 and 16 attached to the first and second shafts 50 and 52 rotate relative to the shaft 222 and to the boom mounting member 20 or other mounting surface, platform or frame to which the shaft 222 is mounted when the inner piston 230 is moved linearly by the application of fluid pressure to one of the third and fourth ports P3 and P4. Again by way of example using grapples as the first and second tool members 14 and 16, the resulting movement by operation of the outer actuator is timed rotation of the grapple tines about the axis 22 serving much like grabbing with the fingers of a hand, and the resulting movement by operation of the inner actuator is rotation of the grapple tines as a unit about the axis 22 much like the rotation of a wrist to provide a high torque articulated tool. This is the reverse of the actuator of FIGS. 14A and 14B.

It should be understood that while splines are shown in the drawings and described herein, the principle of the invention is equally applicable to any form of linear-to-rotary motion conversion arrangement, such as balls or rollers, and that the splines can include any type of groove, thread or channel suitable for such motion conversion.

It will be appreciated that, although specific embodiments of the invention have been described herein for purposes of illustration, various modifications may be made without departing from the spirit and scope of the invention. Accordingly, the invention is not limited except as by the appended claims.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

I claim:

1. A fluid-powered tool assembly, usable with a support platform having an arm, the tool assembly comprising:

a connection member connectable to the arm;

a first tool member having left and right side portions;

a second tool member positioned to cooperate with said first tool member, said second tool member having left and right side portions;

a body having a longitudinal axis and left and right longitudinal end portions, said body having a grooved portion within said body, said body being attached to said connection member for movement of said body with said connection member as a unit, said body having said left end portion thereof positioned toward said left side portions of said first and second tool members and said right end portion thereof positioned toward said right side portions of said first and second tool members;

a first shaft rotatably disposed within said body at said body left end portion and in general alignment with said body axis for rotation about said body axis, said first shaft having a grooved portion positioned toward said body left end portion and a left end portion attached to said left side portion of said first tool member for rotational movement of said first tool member with said first shaft as a unit;

a second shaft rotatably disposed within said body at said body right end portion and in general alignment with said body axis for rotation about said body axis, said second shaft having a grooved portion positioned toward said body right end portion and a right end portion attached to said right side portion of said second tool member for rotational movement of said second tool member with said second shaft as a unit; and a linear-to-rotary force transmitting member mounted for reciprocal longitudinal movement within said body in response to selective application of pressurized fluid thereto, said force transmitting member having a grooved first portion positioned within said body engaging said first shaft grooved portion, a grooved second portion positioned within said body engaging said second shaft grooved portion and a grooved third portion positioned within said body engaging said body grooved portion to translate longitudinal movement of said force transmitting member in a first longitudinal direction into counter rotational movement of said first and said second shafts about said body axis relative to said body to move said first and second tool members toward each other, and to translate longitudinal movement of said force transmitting member in a second longitudinal direction opposite said first longitudinal direction into counter rotational movement of said first and said second shafts about said body axis relative to said body to move said first and second tool members away from each other.

2. The tool assembly of claim 1 wherein said left side portion of said second tool member is rotatably mounted to said left end portion of said first shaft for independent rotation relative thereto, and said right side portion of said first tool member is rotatably mounted to said right end portion of said second shaft for independent rotation relative thereto.

3. The tool assembly of claim 1 further including:

a third shaft rotatably disposed within said body at said body left end portion and in general alignment with said body axis for rotation about said body axis, said third shaft having a grooved portion positioned toward said body left end portion and a left end portion attached to said left side portion of said second tool member for rotational movement of said second tool member with said third shaft as a unit;

a fourth shaft rotatably disposed within said body at said body right end portion and in general alignment with said body axis for rotation about said body axis, said fourth shaft having a grooved portion positioned toward said body right end portion and a right end portion attached to said right side portion of said first tool member for rotational movement of said first tool member with said fourth shaft as a unit; and said linear-to-rotary force transmitting member has a grooved fourth portion positioned within said body engaging said third shaft grooved portion and a grooved fifth portion positioned within said body engaging said fourth shaft grooved portion to translate longitudinal movement of said force transmitting member in said first longitudinal direction into counter rotational movement of said third and fourth shafts about said body axis relative to said body to move said first and second tool members toward each other, and to translate longitudinal movement of said force transmitting member in said second longitudinal direction into counter rotational movement of said third and fourth shafts about said body axis relative to said body to move said first and second tool members away from each other, whereby said first and fourth shafts apply torque to said first tool member and said second and third shafts apply torque to said second tool member.

4. A fluid-powered tool assembly, usable with a support, the tool assembly comprising:

a first tool member having left and right side portions;

a second tool member positioned to cooperate with said first tool member, said second tool member having left and right side portions;

a body having a longitudinal axis and left and right longitudinal end portions, said body being configured for connection to the support, said body having said left end portion thereof positioned toward said left side portions of said first and second tool members and said right end portion thereof positioned toward said right side portions of said first and second tool members;

a first shaft rotatably disposed within said body at said body left end portion and in general alignment with said body axis for rotation about said axis, said first shaft having a left end portion attached to said left side portion of said first tool member for rotational movement of said first tool member with said first shaft as a unit;

a second shaft rotatably disposed within said body at said body right end portion and in general alignment with said body axis for rotation about said axis, said second shaft having a right end portion attached to said right side portion of said second tool member for rotational movement of said second tool member with said second shaft as a unit; and a force transmitting member mounted for movement within said body in response to selective application of pressurized fluid thereto, said force transmitting member engaging said first shaft and said second shaft to translate movement of said force transmitting member in a first direction into counter rotational movement of said first and said second shafts about said body axis relative to said body to move said first and second tool members toward each other, and to translate movement of said force transmitting member in a second direction into counter rotational movement of said first and said second shafts about said body axis relative to said body to move said first and second tool members away from each other.

5. A fluid-powered tool assembly, comprising:

a first tool member;

a second tool member positioned to cooperate with said first tool member;

a body having a longitudinal axis;

a first rotatable member rotatably disposed with respect to said body for rotation about a first rotation axis, said first rotatable member being attached to said first tool member for rotational movement of said first tool member with said first rotatable member as a unit;

a second rotatable member rotatably disposed with respect to said body for rotation about a second rotation axis, said second rotatable member being attached to said second tool member for rotational movement of said second tool member with said second rotatable member as a unit; and a linear-to-rotary force transmitting member mounted for reciprocal longitudinal movement in response to selective application of pressurized fluid thereto, said force transmitting member engaging said first rotatable member and said second rotatable member to translate longitudinal movement of said force transmitting member in a first longitudinal direction into rotational movement of said first rotatable member about said first axis relative to said body in a first rotational direction and into rotational movement of said second rotatable member about said second axis relative to said body in a second rotational direction, and to translate longitudinal movement of said force transmitting member in a second longitudinal direction opposite said first longitudinal direction into rotational movement of said first rotatable member about said first axis relative to said body in a rotational direction opposite said first rotational direction and into rotational movement of said second rotatable member about said second axis relative to said body in a rotational direction opposite said second rotational direction.

6. The tool assembly of claim 5 wherein said force transmitting member engages said body to translate longitudinal movement of said force transmitting member in said first and second longitudinal directions into rotational movement of said first and second rotatable members about said first and second axes, respectively, relative to said body.

7. The tool assembly of claim 5 wherein said first and second rotational directions are opposite rotational directions, with rotational movement of said first and second rotatable members in said first and second rotational directions, respectively, in response to longitudinal movement of said force transmitting member in said first longitudinal direction, producing movement of said first and second tool members toward each other, and rotational movement of said first and second rotatable members in said rotational directions opposite said first and second rotational directions, respectively, in response to longitudinal movement of said force transmitting member in said second longitudinal direction, producing movement of said first and second tool members away from each other.

8. The tool assembly of claim 5 wherein said first rotatable member has a grooved portion and said second rotatable member has a grooved portion, and wherein said force transmitting member has a grooved first portion engaging said first rotatable member grooved portion and a grooved second portion engaging said second rotatable member grooved portion to translate longitudinal movement of said force transmitting member in said first longitudinal direction into rotational movement of said first rotatable member about said first axis relative to said body in said first rotational direction and into rotational movement of said second rotatable member about said second axis relative to said body in said second rotational direction, and to translate longitudinal movement of said force transmitting member in said second longitudinal direction into rotational movement of said first rotatable member about said first axis relative to said body in said rotational direction opposite said first rotational direction and into rotational movement of said second rotatable member about said second axis relative to said body in said rotational direction opposite said second rotational direction.

9. The tool assembly of claim 8 further including:

a third rotatable member rotatably disposed with respect to said body for rotation about a third rotation axis, said third rotatable member being attached to said second tool member for rotational movement of said second tool member with said third rotatable member as a unit, said third rotatable member having a grooved portion;

a fourth rotatable member rotatably disposed with respect to said body for rotation about a fourth rotation axis, said fourth rotatable member being attached to said first tool member for rotational movement of said first tool member with said fourth rotatable member as a unit, said fourth rotatable member having a grooved portion; and said linear-to-rotary force transmitting member has a grooved third portion engaging said third rotatable member grooved portion and a grooved fourth portion engaging said fourth rotatable member grooved portion to translate longitudinal movement of said force transmitting member in said first longitudinal direction into rotational movement of said third rotatable member about said third axis relative to said body in said second rotational direction and into rotational movement of said fourth rotatable member about said fourth axis relative to said body in said first rotational direction, and to translate longitudinal movement of said force transmitting member in said second longitudinal direction into rotational movement of said third rotatable member about said third axis relative to said body in said rotational direction opposite said second rotational direction and into rotational movement of said fourth rotatable member about said fourth axis relative to said body in said rotational direction opposite said first rotational direction, whereby said first and fourth rotatable members apply torque to said first tool member and said second and third rotatable members apply torque to said second tool member.

10. The tool assembly of claim 5 wherein said body has a grooved portion, said first rotatable member has a grooved portion and said second rotatable member has a grooved portion, and wherein said force transmitting member has a grooved first portion engaging said first rotatable member grooved portion, a grooved second portion engaging said second rotatable member grooved portion and a grooved third portion engaging said body grooved portion to translate longitudinal movement of said force transmitting member in said first longitudinal direction into rotational movement of said first rotatable member about said first axis relative to said body in said first rotational direction and into rotational movement of said second rotatable member about said second axis relative to said body in said second rotational direction, and to translate longitudinal movement of said force transmitting member in said second longitudinal direction into rotational movement of said first rotatable member about said first axis relative to said body in said rotational direction opposite said first rotational direction and into rotational movement of said second rotatable member about said second axis relative to said body in said rotational direction opposite said second rotational direction.

11. The tool assembly of claim 10 further including:

a third rotatable member rotatably disposed with respect to said body for rotation about a third rotation axis, said third rotatable member being attached to said second tool member for rotational movement of said second tool member with said third rotatable member as a unit, said third rotatable member having a grooved portion;

a fourth rotatable member rotatably disposed with respect to said body for rotation about a fourth rotation axis, said fourth rotatable member being attached to said first tool member for rotational movement of said first tool member with said fourth rotatable member as a unit, said fourth rotatable member having a grooved portion; and said linear-to-rotary force transmitting member has a grooved fourth portion engaging said third rotatable member grooved portion and a grooved fifth portion engaging said fourth rotatable member grooved portion to translate longitudinal movement of said force transmitting member in said first longitudinal direction into rotational movement of said third rotatable member about said third axis relative to said body in said second rotational direction and into rotational movement of said fourth rotatable member about said fourth axis relative to said body in said first rotational direction, and to translate longitudinal movement of said force transmitting member in said second longitudinal direction into rotational movement of said third rotatable member about said third axis relative to said body in said rotational direction opposite said second rotational direction and into rotational movement of said fourth rotatable member about said fourth axis relative to said body in said rotational direction opposite said first rotational direction, whereby said first and fourth rotatable members apply torque to said first tool member and said second and third rotatable members apply torque to said second tool member.

12. The tool assembly of claim 10 wherein said body includes a center tie rod positioned along said body axis and retaining said first and second rotatable members against longitudinally outward movement relative to each other, said tie rod including a connection portion by which said body is connectable to a support, and having said body grooved portion.

13. The tool assembly of claim 5 further including:

a third rotatable member rotatably disposed with respect to said body for rotation about a third rotation axis, said third rotatable member being attached to said second tool member for rotational movement of said second tool member with said third rotatable member as a unit;

a fourth rotatable member rotatably disposed with respect to said body for rotation about a fourth rotation axis, said fourth rotatable member being attached to said first tool member for rotational movement of said first tool member with said fourth rotatable member as a unit; and said linear-to-rotary force transmitting member engaging said third and fourth rotatable members to translate longitudinal movement of said force transmitting member in said first longitudinal direction into rotational movement of said third rotatable member about said third axis relative to said body in said second rotational direction and into rotational movement of said fourth rotatable member about said fourth axis relative to said body in said first rotational direction, and to translate longitudinal movement of said force transmitting member in said second longitudinal direction into rotational movement of said third rotatable member about said third axis relative to said body in said rotational direction opposite said second rotational direction and into rotational movement of said fourth rotatable member about said fourth axis relative to said body in said rotational direction opposite said first rotational direction, whereby said first and fourth rotatable members apply torque to said first tool member and said second and third rotatable members apply torque to said second tool member.

14. The tool assembly of claim 5 wherein said body has spaced apart first and second longitudinal end portions, and said first rotatable member has an attachment portion to which said first tool member is attached and said second rotatable member has an attachment portion to which said second tool member is attached, said attachment portions of said first and second rotatable members being both located at said body first end portion.

15. The tool assembly of claim 5 wherein said body includes a center tie rod positioned along said body axis and retaining said first and second rotatable members against longitudinally outward movement relative to each other, said tie rod including a connection portion by which said body is connectable to a support.

16. The tool assembly of claim 5 wherein said body has spaced apart first and second longitudinal end portions, and said first and second rotatable members each extend between said body first and second end portions with said first and second rotation axes thereof in spaced apart arrangement.

17. The tool assembly of claim 16 wherein said first rotatable member has an attachment portion at each of said body first and second end portions attached to said first tool member, and said second rotatable member has an attachment portion at each of said body first and second end portions attached to said second tool member.

18. The tool assembly of claim 17 wherein said force transmitting member is a piston sleeve with first and second spaced apart apertures therein with said first rotatable member extending through said first aperture and said second rotatable member extending through said second aperture.

19. The tool assembly of claim 18 wherein said first rotatable member has a grooved portion and said second rotatable member has a grooved portion, and wherein said piston sleeve has a grooved first portion within said first aperture engaging said first rotatable member grooved portion and a grooved second portion within said second aperture engaging said second rotatable member grooved portion to translate longitudinal movement of said piston sleeve in said first longitudinal direction into rotational movement of said first rotatable member about said first axis relative to said body in said first rotational direction and into rotational movement of said second rotatable member about said second axis relative to said body in said second rotational direction, and to translate longitudinal movement of said piston sleeve in said second longitudinal direction into rotational movement of said first rotatable member about said first axis relative to said body in said rotational direction opposite said first rotational direction and into rotational movement of said second rotatable member about said second axis relative to said body in said rotational direction opposite said second rotational direction.

20. The tool assembly of claim 5 wherein said body is a first body and the tool assembly further includes a second body with said first body being rotatable relative to said second body, and further includes another linear-to-rotary force transmitting member mounted for reciprocal longitudinal movement in response to selective application of pressurized fluid thereto, said another force transmitting member engaging said first and second bodies to translate longitudinal movement of said another force transmitting member in a third longitudinal direction into one of clockwise or counterclockwise relative rotational movement of said first body relative to said second body and to translate longitudinal movement of said another force transmitting member in a fourth longitudinal direction into the other of clockwise or counterclockwise relative rotational movement of said first body relative to said second body.

21. A fluid-powered rotary actuator for providing timed rotational movement of first and second external members, comprising:

a body having a longitudinal axis and first and second longitudinal end portions, said body having a grooved portion within said body;

a first shaft rotatably disposed within said body at said body first end portion and in general alignment with said body axis for rotation about said body axis, said first shaft having a grooved portion positioned toward said body first end portion and a portion adapted for coupling to the first external member for rotational movement of the first external member with said first shaft as a unit;

a second shaft rotatably disposed within said body at said body second end portion and in general alignment with said body axis for rotation about said body axis, said second shaft having a grooved portion positioned toward said body second end portion and a portion adapted for coupling to the second external member for rotational movement of the second external member with said second shaft as a unit;and a linear-to-rotary force transmitting member mounted for reciprocal longitudinal movement within said body in response to selective application of pressurized fluid thereto, said force transmitting member having a grooved first portion positioned within said body engaging said first shaft grooved portion, a grooved second portion positioned within said body engaging said second shaft grooved portion and a grooved third portion positioned within said body engaging said body grooved portion to translate longitudinal movement of said force transmitting member in a first longitudinal direction into rotational movement of said first shaft about said body axis relative to said body in a first rotational direction and into rotational movement of said second shaft about said body axis relative to said body in a second rotational direction opposite said first rotational direction, and to translate longitudinal movement of said force transmitting member in a second longitudinal direction opposite said first longitudinal direction into rotational movement of said first shaft about said body axis relative to said body in said second rotational direction and into rotational movement of said second shaft about said body axis relative to said body in said first rotational direction.

22. The actuator of claim 21 further including:

a third shaft rotatably disposed within said body at said body first end portion and in general alignment with said body axis for rotation about said body axis, said third shaft having a grooved portion positioned toward said body first end portion and a portion adapted for coupling to the second external member for rotational movement of the second external member with said third shaft as a unit;

a fourth shaft rotatably disposed within said body at said body second end portion and in general alignment with said body axis for rotation about said body axis, said fourth shaft having a grooved portion positioned toward said body second end portion and a portion adapted for coupling to the first external member for rotational movement of the first external member with said fourth shaft as a unit; and said linear-to-rotary force transmitting member has a grooved fourth portion positioned within said body engaging said third shaft grooved portion and a grooved fifth portion positioned within said body engaging said fourth shaft grooved portion to translate longitudinal movement of said force transmitting member in said first longitudinal direction into rotational movement of said third shaft about said body axis relative to said body in said second rotational direction and into rotational movement of said fourth shaft about said body axis relative to said body in said first rotational direction, and to translate longitudinal movement of said force transmitting member in said second longitudinal direction into rotational movement of said third shaft about said body axis relative to said body in said first rotational direction and into rotational movement of said fourth shaft about said body axis relative to said body in said second rotational direction, whereby said first and fourth shafts apply torque to the first external member and said second and third shafts apply torque to the second external member.

23. The actuator of claim 21 wherein said first shaft further includes an idler mount portion for rotatably mounting the second external member thereto to allow independent rotation of the second external member relative to said first shaft idler mount portion, and said second shaft further includes an idler mount portion for rotatably mounting the first external member thereto to allow independent rotation of the first external member relative to said second shaft idler mount portion.

24. The actuator of claim 21 for use with a third external member, wherein said body is adapted for coupling to the third external member for movement of said body with the third external member as a unit.

25. The actuator of claim 24 wherein said body includes a center tie rod positioned along said body axis and retaining said first and second shafts against longitudinally outward movement relative to each other, said tie rod comprising at least a portion of said body adapted for coupling to the third external member, and having said body grooved portion.

26. The actuator of claim 21 wherein said first shaft has an attachment portion configured for coupling the first second external member thereto and said second shaft has an attachment portion configured for coupling the second external member thereto, said attachment portions of said first and second shafts being both located at said body first end portion.

27. A fluid-powered rotary actuator for providing timed rotational movement of first and second external members, comprising:

a body having a longitudinal axis;

a first rotatable member rotatably disposed with respect to said body for rotation about a first rotation axis with a portion adapted for coupling to the first external member for rotational movement of the first external member with said first rotatable member as a unit, said first rotatable member having a grooved portion;

a second rotatable member rotatably disposed with respect to said body for rotation about a second axis with a portion adapted for coupling to the second external member for rotational movement of the second external member with said second rotatable member as a unit, said second rotatable member having a grooved portion; and a linear-to-rotary force transmitting member mounted for reciporcal longitudinal movement in response to selective application of pressurized fluid thereto, said force transmitting member engaging said first and second rotatable members to translate longitudinal movement of said force transmitting member in a first longitudinal direction into rotational movement of said first rotatable member about said first axis relative to said body in a first rotational direction nd into rotational movement of said second rotatable member about said second axis relative to said body in a second rotational direction, and to translate longitudinal movement of said force transmitting member in a second logitudinal direction opposite said first logitudinla direction into rotational movement of said first rotatable member about said first axis relative to said body in a rotational direction opposite said first rotational direction and into rotational movement of said second rotatable member about said second axis relative to said body in a rotational direction opposite said secondrotational direction, said force transmitting member having a grooved first portion engaging said first rotatable member grooved portion and a grooved second portion engaging said second rotatable member grooved portion to translate longitudinal movement of said force transmitting member in said first longitudinal direction into rotational movement of said first rotatable member about said first axis relative to said body in said first rotational direction and into rotational movement of said second rotatable member about said second axis relative to said body in said second rotational direction, and to translate longitudinal movement of said force transmitting member in said second longitudinal direction into rotational movement of said first rotatable member about said first axis relative to said body in said rotational direction opposite said first rotational direction and into rotational movement of said second rotatable member about said second axis relative to said body in said rotational direction opposite said second rotational direction.

28. The actuator of claim 27 wherein said force transmitting member engages said body to translate longitudinal movement of said force transmitting member in said first and second longitudinal directions into rotational movement of said first and second rotatable members about said first and second axes, respectively, relative to said body.

29. The actuator of claim 27 wherein said first and second rotational directions are opposite rotational directions, with rotational movement of said first and second rotatable members in said first and second rotational directions, respectively, in response to longitudinal movement of said force transmitting member in said first longitudinal direction, producing movement of said first and second external members toward each other, and rotational movement of said first and second rotatable members in said rotational directions opposite said first and second rotational directions, respectively, in response to longitudinal movement of said force transmitting member in said second longitudinal direction, producing movement of said first and second external members away from each other.

30. The actuator of claim 27 further including:

a third rotatable member rotatably disposed with respect to said body for rotation about a third rotation axis, said third rotatable member having a portion adapted for coupling to the second external member for rotational movement of the second external member with said third rotatable member as a unit, said third rotatable member having a grooved portion;

a fourth rotatable member rotatably disposed with respect to said body for rotation about a fourth rotation axis, said fourth rotatable member having a portion adapted for coupling to the first external member for rotational movement of the first external member with said fourth rotatable member as a unit, said fourth rotatable member having a grooved portion; and said linear-to-rotary force transmitting member has a grooved third portion engaging said third rotatable member grooved portion and a grooved fourth portion engaging said fourth rotatable member grooved portion to translate longitudinal movement of said force transmitting member in said first longitudinal direction into rotational movement of said third rotatable member about said third axis relative to said body in a third rotational direction and into rotational movement of said fourth rotatable member about said fourth axis relative to said body in a fourth rotational direction, and to translate longitudinal movement of said force transmitting member in said second longitudinal direction into rotational movement of said third rotatable member about said third axis relative to said body in said rotational direction opposite said third rotational direction and into rotational movement of said fourth rotatable member about said fourth axis relative to said body in said rotational direction opposite said fourth rotational direction.

31. The actuator of claim 27 for use with a third external member, wherein said body is adapted for coupling to the third external member for movement of said body with the third external member as a unit, wherein said body includes a center tie rod positioned along said body axis and retaining said first and second rotatable members against longitudinally outward movement relative to each other, said tie rod comprising at least a portion of said body adapted for coupling to the third external member.

32. The actuator of claim 27 wherein said body has spaced apart first and second longitudinal end portions, and said portions of said first and second rotatable members adapted for coupling to the first and second external members are both located at said body first end portion.

33. The actuator of claim 27 further including:

a third rotatable member rotatably disposed with respect to said body for rotation about a third rotation axis, said third rotatable member having a portion adapted for coupling to the second external member for rotational movement of the second external member with said third rotatable member as a unit;

a fourth rotatable member rotatably disposed with respect to said body for rotation about a fourth rotation axis, said fourth rotatable member having a portion adapted for coupling to the first external member for rotational movement of the first external member with said fourth rotatable member as a unit; and said linear-to-rotary force transmitting member engaging said third and fourth rotatable members to translate longitudinal movement of said force transmitting member in said first longitudinal direction into rotational movement of said third rotatable member about said third axis relative to said body in a third rotational direction and into rotational movement of said fourth rotatable member about said fourth axis relative to said body in a fourth rotational direction, and to translate longitudinal movement of said force transmitting member in said second longitudinal direction into rotational movement of said third rotatable member about said third axis relative to said body in said rotational direction opposite said third rotational direction and into rotational movement of said fourth rotatable member about said fourth axis relative to said body in said rotational direction opposite said fourth rotational direction.

34. The actuator of claim 27 wherein said body has spaced apart first and second longitudinal end portions, and said first and second rotatable members each extend between said body first and second end portions with said first and second rotation axes thereof in spaced apart arrangement.

35. The actuator of claim 34 wherein said first rotatable member has first and second end portions, each adapted for coupling to the first external member, and said second rotatable member has first and second end portions, each adapted for coupling to the second external member, said first end portions of said first and second rotatable members being located at said body first end portion and said second end portions of said first and second rotatable members being located at said body second end portion.

36. The actuator of claim 35 wherein said force transmitting member is a piston sleeve with first and second spaced apart apertures therein with said first rotatable member extending through said first aperture and said second rotatable member extending through said second aperture.

37. The actuator of claim 27 wherein said body is a first body and the actuator further includes a second body with the first body being rotatable relative to said second body, and further includes another linear-to-rotary force transmitting member mounted for reciprocal longitudinal movement in said first and second longitudinal directions in response to selective application of pressurized fluid thereto, said another force transmitting member engaging said first and second bodies to translate longitudinal movement of said another force transmitting member in a third longitudinal direction into one of clockwise or counterclockwise relative rotational movement of said first body relative to said second body and to translate longitudinal movement of said another force transmitting member in a fourth longitudinal direction into the other of clockwise or counterclockwise relative rotational movement of said first body relative to said second body.

38. A fluid-powered rotary actuator for providing timed rotational movement of first and second external members, comprising:

a body having a longitudinal axis; said body having a grooved portion;

a first rotatable member rotatably disposed with respect to said body for rotation about a first rotation axis with a portion adapted for coupling to the first external member for rotational movement of the first external member with said first rotatable member as a unit, said first rotatable member having a grooved portion;

a second rotatable member rotatably disposed with respect to said body for rotation about a second axis with a portion adapted for coupling to the second external member for rotational movement of the second external member with said second rotatable member as a unit, said second rotatable members having a grooved portion; and a linear-to-rotary force transmitting member mounted for reciprocal longitudinal movement in responses to selective application of pressurized fluid thereto, said force transmitting member engaging said first and second rotatable members to translate longitudinal movement of said force transmitting member in a first longitudinal direction into rotational movement of said first rotatable member about said first axis relative to said body in said a first rotational direction and into rotational movement of said second rotatable member about said second axis relative to said body in a second rotational direction, and to translate longitudinal movement of said force transmitting member in a second longitudinal direction opposite said first longitudinal direction into rotational movement of said first rotatable member about said first axis relative to said body in said rotational direction opposite said first rotational direction and into rotational movement of said second rotatable member about said second axis relative to said body in a rotational direction opposite said second rotational direction, said force transmitting member having a grooved first portion engaging said first rotatable member grooved portion, a grooved second portion engaging said second rotatable member grooved portion and a grooved third portion engaging said body grooved portion to translate longitudinal movement of said force transmitting member in said first longitudinal direction into rotational movement of said first rotatable member about said first axis relative to said body in said first rotational direction into rotational movement of said second rotatable member about said second axis relative to said body in second rotational direction, and to translate longitudinal movement of said force transmitting member in said second longitudinal direction into rotational movement of said first rotatable member about said first axis relative to said body in said rotational direction opposite said first rotational direction and into rotational movement of said second rotatable member about said second axis relative to said body in a rotational direction opposite said second rotational direction.

39. The actuator of claim 38 further including:

a third rotatable member rotatably disposed with respect to said body for rotation about a third rotation axis, said third rotatable member having a portion adapted for coupling to the second external member for rotational movement of the second external member with said third rotatable member as a unit, said third rotatable member having a grooved portion;

a fourth rotatable member rotatably disposed with respect to said body for rotation about a fourth rotation axis, said fourth rotatable member having a portion adapted for coupling to the first external member for rotational movement of the first external member with said fourth rotatable member as a unit, said fourth rotatable member having a grooved portion; and said linear-to-rotary force transmitting member has a grooved fourth portion engaging said third rotatable member grooved portion and a grooved fifth portion engaging said fourth rotatable member grooved portion to translate longitudinal movement of said force transmitting member in said first longitudinal direction into rotational movement of said third rotatable member about said third axis relative to said body in a third rotational direction and into rotational movement of said fourth rotatable member about said fourth axis relative to said body in a fourth rotational direction, and to translate longitudinal movement of said force transmitting member in said second longitudinal direction into rotational movement of said third rotatable member about said third axis relative to said body in said rotational direction opposite said third rotational direction and into rotational movement of said fourth rotatable member about said fourth axis relative to said body in said rotational direction opposite said fourth rotational direction.

40. The actuator of claim 38 for use with a third external member, wherein said body is adapted for coupling to the third external member for movement of said body with the third external member as a unit.

41. The actuator of claim 40 wherein said body includes a center tie rod positioned along said body axis and retaining said first and second rotatable members against longitudinally outward movement relative to each other, said tie rod comprising at least a portion of said body adapted for coupling to the third external member, and having said body grooved portion.

42. A fluid-powered rotary actuator for providing timed rotational movement of first and second external members, comprising:

a body having a longitudinal axis;

a first rotatable member rotatably disposed with respect to said body for rotation about a first rotation axis with a portion adapted for coupling to the first external member for rotational movement of the first external member with said first rotatable member as a unit, said first rotatable member further including an idler mount portion adapted to rotatably mount the second external member thereto to allow independent rotation of the second external member relative to said first shaft idler mount portion;

a second rotatable member rotatably disposed with respect to said body for rotation about a second axis with a portion adapted for coupling to the second external member for rotational movement of the second external member with said second rotatable member as a unit, said second rotatable members further includes an idler mount portion adapted to rotatably mount the first external thereto allow independent rotation of the first external member relative to said second shaft idler mount portion; and a linear-to-rotary force transmitting member mounted for reciprocal longitudinal movement in responses to selective application of pressurized fluid thereto, said force transmitting member engaging said first and second rotatable members to translate longitudinal movement of said force transmitting member in a first longitudinal direction into rotational movement of said first rotatable member about said first axis relative to said body in a first rotational direction and into rotational movement of said second rotatable member about said second axis relative to said body in a second rotational direction, and to translate longitudinal movement of said force transmitting member in a second longitudinal direction opposite said first longitudinal direction into rotational movement of said first rotatable member about said first axis relative to said body in a rotational direction opposite said first rotational direction, and into rotational movement of said second rotatable member about said second axis relative to said body in rotational direction opposite said second rotational direction.

* * * * *